United States Patent [19]

Ohba et al.

[11] Patent Number: 4,483,124

[45] Date of Patent: Nov. 20, 1984

[54] SHEET-LIKE MATERIAL PROCESSING APPARATUS

[75] Inventors: Hiroshi Ohba; Shigeo Horino, both of Tokyo, Japan

[73] Assignee: Tokyo Shibaura Denki Kabushiki Kaisha, Japan

[21] Appl. No.: 457,131

[22] Filed: Jan. 11, 1983

Related U.S. Application Data

[63] Continuation of Ser. No. 176,567, Aug. 8, 1980, abandoned.

[30] Foreign Application Priority Data

Sep. 21, 1979 [JP] Japan ..... 54-120608

[51] Int. Cl.[3] ..... B07C 5/34; B65B 13/10; B65B 57/10

[52] U.S. Cl. ..... 53/54; 53/498; 53/502; 53/587; 53/588; 209/534

[58] Field of Search ..... 53/588, 587, 582, 502, 53/500, 498, 493, 54, 52, 211, 419; 209/534, 569, 583

[56] References Cited

U.S. PATENT DOCUMENTS

| | | | |
|---|---|---|---|
| 2,612,737 | 10/1952 | Thielens | 53/587 X |
| 3,759,382 | 9/1973 | Walkley et al. | 209/534 X |
| 3,938,663 | 2/1976 | Carnes et al. | 209/534 |
| 4,020,616 | 5/1977 | Nakajima et al. | 53/587 X |
| 4,025,420 | 5/1977 | Horino | 209/534 X |
| 4,155,213 | 5/1979 | Blanton et al. | 53/587 |
| 4,166,030 | 8/1979 | Lewis et al. | 209/534 |

FOREIGN PATENT DOCUMENTS

| | | | |
|---|---|---|---|
| 2502987 | 10/1975 | Fed. Rep. of Germany | 209/534 |
| 51598 | 4/1979 | Japan | 209/534 |

*Primary Examiner*—James F. Coan

*Attorney, Agent, or Firm*—Cushman, Darby & Cushman

[57] ABSTRACT

A sheet-like material processing apparatus is provided with a pre-processing section and a post-processing section. In the pre-processing section, the sheet-like material set in the supply section is taken out sheet by sheet and those taken-out ones are sorted, by an inspecting device, into at least two kinds of sheet-like material. A transfer/sorting device physically sorts those sheet-like material on the basis of the sorting by the inspection device. The sorted sheet-like material are separately collected each for a given number of the sheet-like material by a sorting and collecting device, and then are bundled by a sheet bundling device. A transfer device transfers the given number of the bundled sheet-like material. Of those sheet-like material transferred by said transfer device, the unreusable ones are invalidated by an invalidating device.

29 Claims, 53 Drawing Figures

FIG. 9A
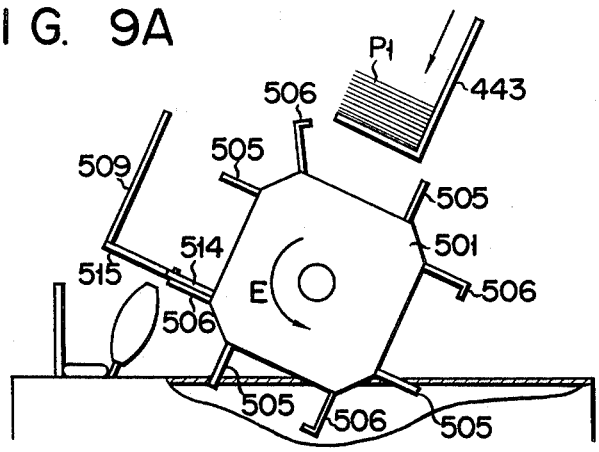
FIG. 9B
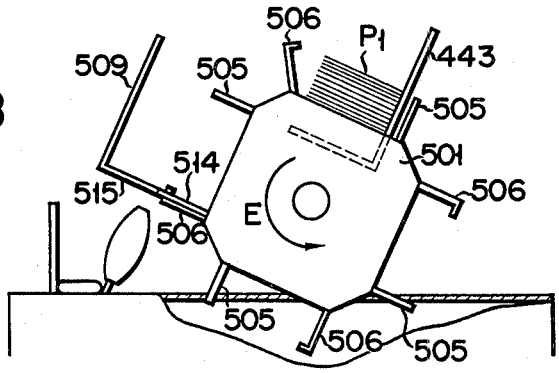
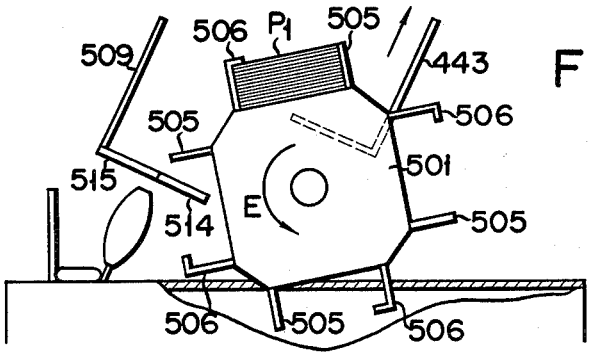
FIG. 9C

FIG. 9D
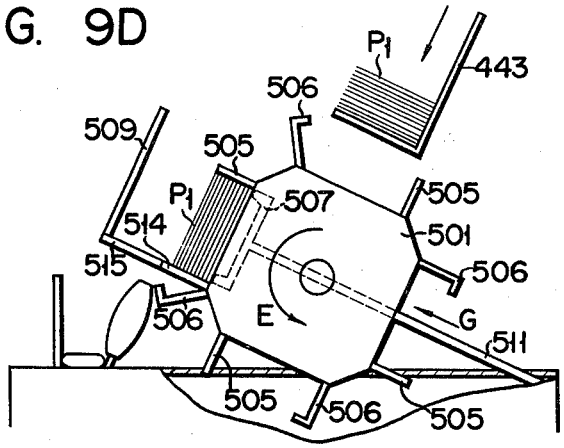
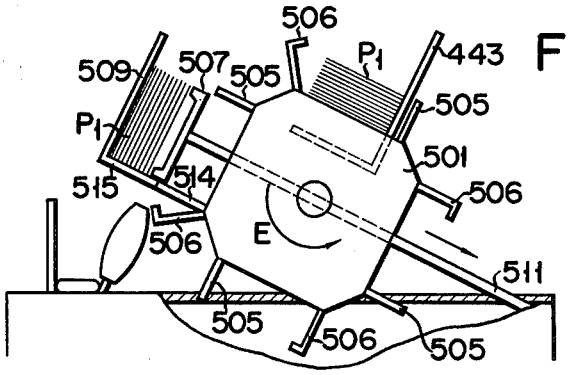
FIG. 9E
FIG. 9F
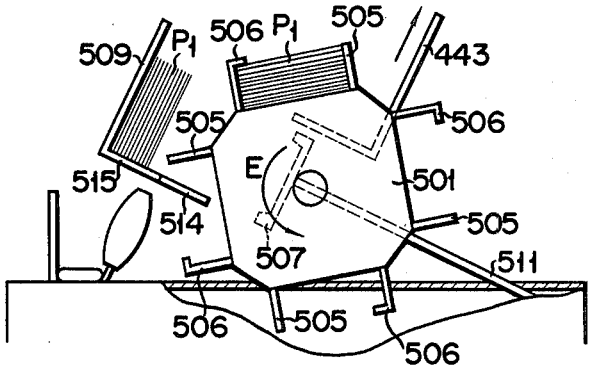

SHEET-LIKE MATERIAL PROCESSING APPARATUS

This is a continuation of U.S. patent application Ser. No. 176,567, filed Aug. 8, 1980, and now abandoned.

BACKGROUND OF THE INVENTION

The present invention relates to a sheet-like material processing apparatus such as securities, for example, checks or slips, which is supplied with sheet like materials of the same kind, classifies them into several classes, stacks the sheet-like materials of the same class to make a unit sheet-stack, and bundles the unit sheet-stack.

The apparatus of this type has a sequence of steps for processing the sheet-like materials. Firstly, sheet-like materials such as securities are set in a sheet supply section; the sheets set are successively taken-out sheet by sheet; the taken-out sheets are inspected, by an inspecting section, under a given inspecting condition and classified into three groups including reusable sheet group, unreusable sheet group and unidentifiable sheet group. The reusable sheets are effective and reusable and will be called normal sheets. The unreusable sheets are effective but not reusable and will be called soiled sheets, the unidentifiable sheets are those which are unidentifiable in the inspection section, for example, those sheets taken out superposedly, or those sheets not to be processed by the apparatus now used. In this respect, the unidentifiable sheet will be referred to as a sheet to be rejected. After the classifying step, the normal and soiled sheets are counted and stacked into a corresponding unit sheet-stack having, for example, 100 sheets depending on the result of the count, and then the unit sheet-stack is bundled and impressed with a given print.

The bundled soiled sheets are burned in an incinerator for the discard. Before the burning of them, the bundled sheets are generally punched, by a punching machine, at a given location on the soiled sheets, for example, where numbers, prints or signs are marked, for prohibiting those from being again used erroneously or maliciously, and for ease of the succeeding handling the soiled sheets. Conventionally, the bundles of soiled sheets are once collected and then are supplied to the punching machine by the hands. This requires a more strictness for the handling the bundles of the soiled sheets transferred from the sheet-like material processor. Additionally, the punching work of the bundled soiled sheets, or sheet-invalidation process, is troublesome and time-consuming.

SUMMARY OF THE INVENTION

Accordingly, an object of the invention is to provide a sheet-like material processing apparatus which successfully overcome the above-mentioned disadvantages.

Another object of the present invention is to provide a sheet-like material processing apparatus which provides an easy handling of the unreusable bundled sheets in the stage following the sheet-invalidation process, by employing an automatic control of the sheet-invalidation process.

Yet another object of the present invention is to provide a sheet-like material processing apparatus with labor saving feature by employing an automatic supply of the unreusable sheet-like material to a sheet-invalidation section.

The present invention may be summarized as a sheet-like material processing apparatus involving: sheet take-out/transfer means for taking out sheet-like material set in a sheet supply section on a sheet-by-sheet basis and transfers the material; inspecting means which detects and inspects the material transferred by the take-out/-transfer means to classify the material into at least two classes; transfer/sorting means for transferring the material passed the inspecting means and sorting the material on the bases of the result of the inspection of the inspecting means; collecting means for collecting the material sorted by the transfer/sorting means every given number of the materials; material bundling means for bundling the sorted and collected material of the given number into blocks of the material; transfer means for transferring the material bundled by the bundling means; bundled-material collecting means for collecting the bundled-material transferred by the transfer means; and bundling means for bundling the bundled-material blocks collected by the bundled-material collecting means every given number of the material blocks.

BRIEF DESCRIPTION OF THE DRAWINGS

FIGS. 3 through 6 illustrate a detailed construction of a correcting device used in the apparatus shown in FIG. 1, in which FIG. 3 is a front view of the device, FIG. 4 is a plan view, FIG. 5 is a side view, and FIG. 6 is a front view of part of the device;

FIGS. 7 through 8 illustrate a detailed construction of a unit sheet-stack bundling device shown in FIG. 1 in which FIG. 7 is a side view of the device and FIG. 8 is a plan view;

FIGS. 9A to 9F illustrate structure of a rotatory drum and its related mechanism in the unit sheet-stack bundling device shown in FIGS. 7 to 8;

FIGS. 16A to 16C illustrate in detail of an invalidating device in which FIG. 16A is its front view, FIG. 16B is its side view and FIG. 16C is its cross sectional view;

DETAILED DESCRIPTION OF THE PREFERRED EMBODIMENT

Figure 1A:
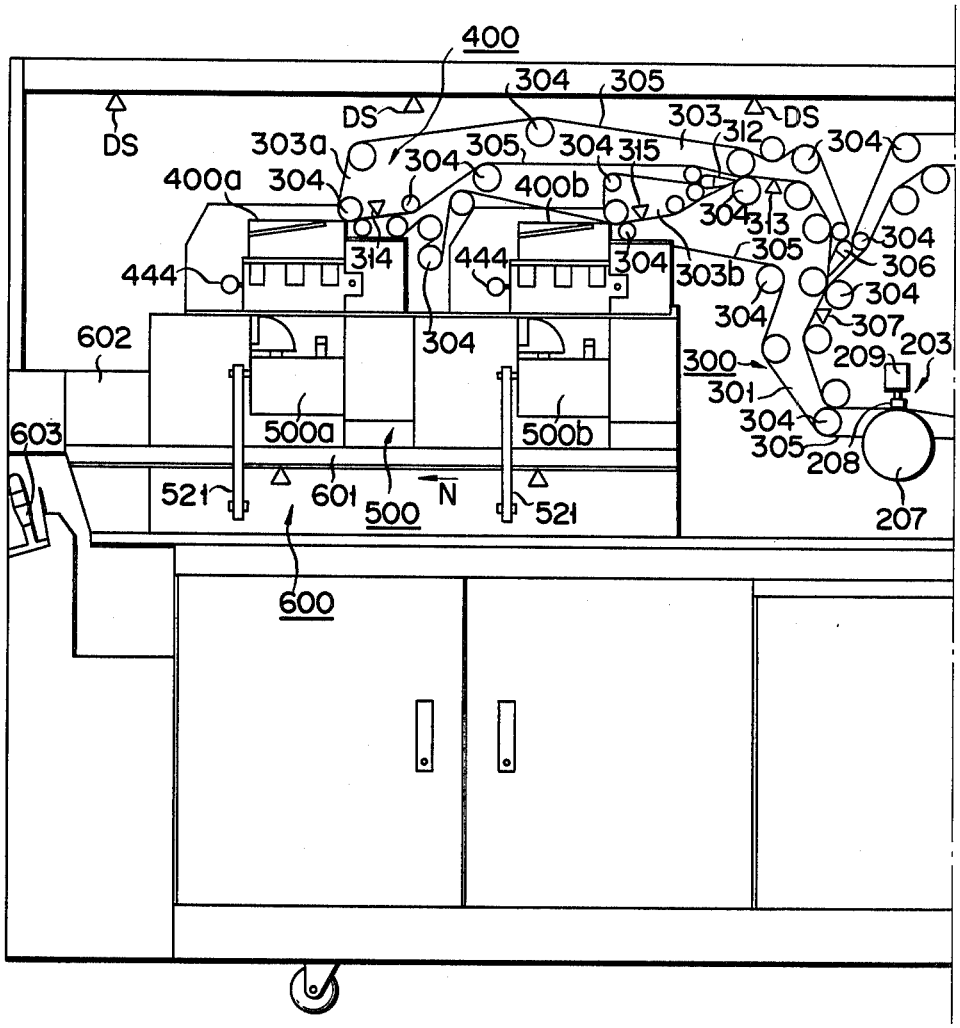
FIGS. 1A and 1B are a schematic diagram of the first half of a sheet-like material processing apparatus according to an embodiments of the present invention.

The detailed description of the invention will proceed by using an apparatus for processing sheet-like material such as securities, for example, checks or slips. The sheet processing apparatus detects features of the securities, classifying the sheets sheet-by-sheet base, and sorts the securities. Then, the apparatus bundles the sorted sheets every 100 sheets and further bundles the 100-sheet bundles every 10 bundles.

Securities such as checks or stock certificates handled in the apparatus are classified into the following three:

(1) Normal sheet: Sheet judged to be normal and available as the result of its inspection and, after it is processed by the apparatus, is used again in its field.

(2) Soiled sheet: Sheet judged to be normal and available as the result of its inspection and, after it is processed by the apparatus, is collected by the issuing side and is discarded.

(3) Unidentifiable sheet or sheet to be rejected: This sheet includes an invalid sheet, an unidentifiable sheet and a foreign sheet. The invalid sheet is the one judged to be false or invalid. The unidentifiable sheet is the one which can not be inspected for the reason that the sheet has a great scar or scars or is taken out in a state superposed with another sheet. The foreign sheet is a sheet different from the sheet to be processed by the apparatus.

Of those securities, which have been sorted into the normal, soiled and to-be-rejected sheets, the normal and soiled sheets are stacked into unit sheet-stacks each including 100 sheets. The to-be-rejected sheets are again processed by the apparatus of the invention for properly processing the superposedly taken out sheets. Those sheets judged as the unidentifiable sheets, even after the second processing by the apparatus, are processed manually by an operator.

The normal and soiled unit sheet-stacks are each transferred as a 100-sheet-stack to corresponding proper stations. At this stage, the 100-sheet-stack or unit sheet-stack is merely stacked but not yet bundled. Then, those unit sheet-stacks are bundled at the proper station. This bundling operation will be called merely "bundling". The bundling is performed in a manner that a bundling tape such as a paper tape is looped around the unit sheet-stack and the external end of the loop is bonded to the outer periphery of the wounded portion. The bundling tape will be called a small strip. In the embodiment, the normal unit sheet-stack is bundled by a green paper tape; the soiled unit sheet-stack by a yellow paper tape. The bundled unit sheet-stacks of the normal and soiled sheets are transferred through the same transfer path. The name of the operator, the date and the like are stamped on the bundled sheet-stack in midway of the transfer. The stamp is made on the bundling tape. After the stamping, the bundled normal and soiled unit sheet-stacks are separately collected. The normal unit sheet-stacks are collected directly. On the other hand, the soiled unit sheet-stacks are collected after being subjected to the invalidation process for inhibiting the reuse of them. Those collected normal and soiled unit sheet-stacks are bundled and tied every given number of stacks, for example, 10 stacks, in a manner that 10 stacks piled up are girded in cross with a paper tape or tapes. The paper tape will be called a large strip. The 10-stack units are collected by a bunch collecting section. The 10-stack unit girded will also be called a bunch of the stacked sheets. The explanation to follow is the elaboration of the sheet-like material processing apparatus which performs the above-mentioned processing in continuous manner, relating to the construction and the operation mainly.

GENERAL CONSTRUCTION

Figure 1B:
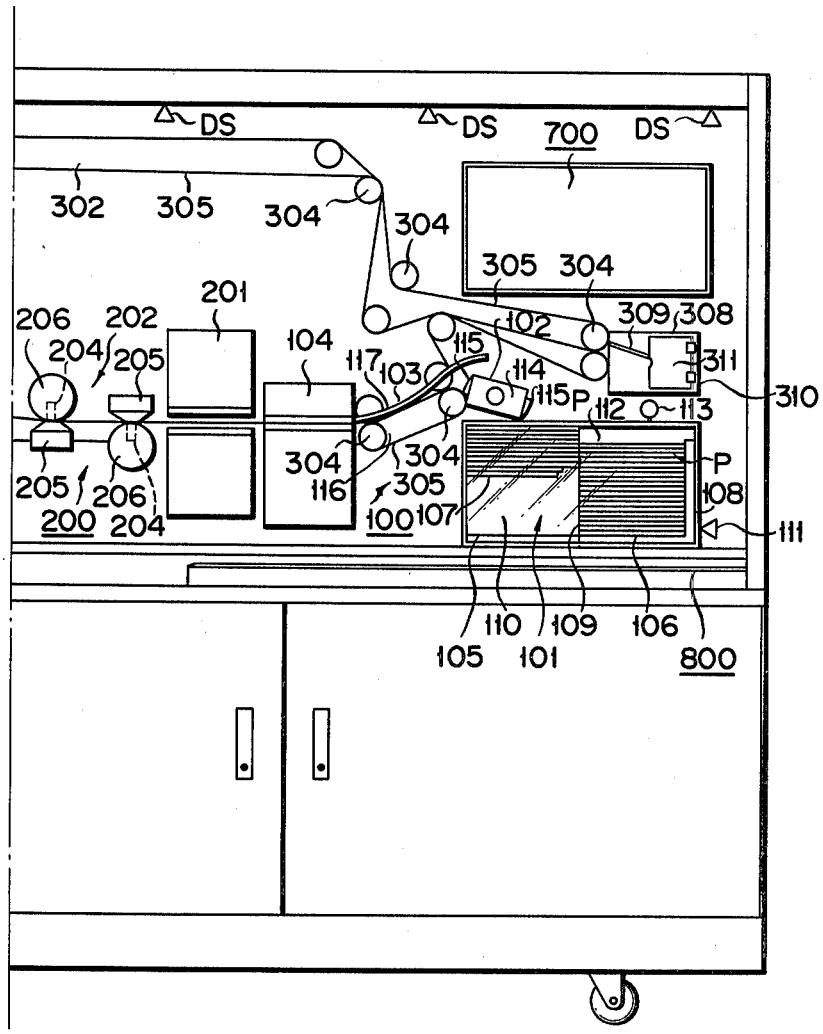

As shown in FIG. 1, the sheet-like material processing apparatus according to the invention is comprised of a sheet take-out/transfer device 100, a sheet inspection device 200, a sheet transfer/sorting or classifying device 300, a unit sheet-stack forming device 400, a unit sheet-stack bundling device 500, a bundled unit sheet-stack classifying or sorting device 600, a display device 700. The sheet take-out/transfer device 100 takes out securities P (referred merely to as sheets) stacked in vertical direction sheet by sheet by means of a vacuum means and then are transferred to the sheet inspection device 200. The sheet inspection device 200 performs a predetermined inspection about the incoming sheets P. The sheet transfer/classifying device 300 classifies the sheet P passed the inspection device 200 on the basis of the result of the inspection and then transfers it to the unit sheet-stack forming device 400. The unit sheet-stack forming device 400 stacks the normal or soiled sheets transferred through the sheet transfer/classifying device 300 for every 100 sheets, being held horizontally thereby to form the normal unit sheet-stack or the soiled unit sheet-stack. Then, those stacks are transferred to the unit sheet-stack bundling device 500. The unit sheet-stack forming device 400 is comprised of a normal unit sheet-stack forming device **400*a* and a soiled unit sheet-stack forming device 400*b*. The sheet-stack bundling device 500 is comprised of a normal unit sheet-stack bundling device 500*a* and a soiled unit sheet-stack bundling device 500*b*. The bundled unit sheet-stack classifying device 600 classifies the bundled unit sheet-stacks transferred from the bundling device 500 into the bundled normal unit sheet-stacks and the bundled soiled unit sheet-stacks, and collects them at the corresponding places, respectively. The display device 700** displays on a graphic panel operating states such as the number of the sheets processed, trouble locations, and error contents.

SHEET TAKE-OUT AND TRANSFER

Referring again to FIG. 1, the sheet take-out and transfer device 100 is comprised of a sheet supply section 101, a sheet take-out section 102, a sheet receiving section 103, and a sheet cleaner section 104. The sheet supply section 101 is separated into a left sheet supply chamber 105 and a right sheet supply chamber 106, which respectively contain sheet pressing boards 107 and 108. Provided between both the supply chambers 105 and 106, a parting plate 109 which is slidable vertically. The sheet pressing plate 107 pushes up the sheets P placed thereon and presses them against the sheet take-out section 102 side with a fixed pressure. The sheet pressing plate 108, shaped like an inverse L, transfers the sheets P in the right supply chamber 106 to the left sheet supply chamber 105. The horizontal part of the sheet pressing plate 108 has a number of rod like members arranged like a drain board so as to couple with the bottom part of the left sheet supply chamber 105 in a telescopic manner. The sheets P stacked are placed on the drain board bottom of the left sheet supply chamber 105. The vertical part of the sheet pressing board 108 trues up vertically one side edges of the sheets P placed on the horizontal part thereof.

In front of the sheet supply section 101, a cover 110 which is transparent and slidable between both the sheet supply chambers 105 and 106. The transparent cover 110 normally closes the front opening section of the right sheet supply chamber 106, while is moved to close the front opening section of the left sheet supply chamber 105 only when the sheets P are supplied onto the sheet pressing plate 108, supplementally. Such a movement of the cover 110 is sensed by a sensor 111 and, in response to the sensing signal from the sensor 111 the parting plate 109 ascends from the bottom surfaces of the sheet supply chambers 105 and 106, so that both the chambers 105 and 106 are partitioned each other. Incidentally, the parting plate 109 is normally placed below the bottom surface of the supply chambers 105 and 106. On the opposite side to the cover 110 of the sheet supply chambers 105 and 106, a reference plain 112 is provided which regulates from the rear side of the apparatus another side edges of the sheets P accommodated in both the chambers 105 and 106 for arranging the another side edges vertically. The reference plain is slidable back and forth as viewed in the apparatus by operating a sheet kind setting dial 113. The sheet kind setting dial 113 is used to set kinds of the sheets P to be handled by the apparatus. The apparatus of the present embodiment handles four kinds of sheets W, X, Y and Z, for example, with different widths and lengths. This is the reason for sliding the reference plain 112 back and forth as in the drawing for setting the regulating position of the rear edges of the stacked sheets P in accordance with the width of the sheets P to be handled.

The sheet take-out section 102 is comprised of a rotor 114 rotating clockwise and absorbing chips 115 and 115 provided on both sides of the rotor 114. The rotor 114 is rotated clockwise by a drive source (not shown). The absorbing chip 115 is shaped such that the thickness thereof gradually decreases in the rotating direction of the rotor 114, and has a smoothed surface. The absorption chip 115 has absorbing holes (not shown) at the surface which communicate with a vacuum device (not shown). The sheet receiving section 103 transfers the sheets P taken out by the take-out section 102 to the sheet transfer/classifying device 300, and is comprised of a transfer path 116 succeeding to the sheet transfer/-classigying device 300 and a guide plate 117. A sheet cleaning section 104 communicates with a vacuum device (not shown) to clean dust attached to the sheet P transferred by the transfer/classifying device 300 by absorbing it. The cleaning section 104 lessens an adverse effect of the dust upon the inspection by the inspection device 200 to be described later.

The operation of the take-out/transfer device 100 will be described. Firstly, a kind of the sheet to be processed is set by operating the sheet kind setting dial 113. Upon the operation of the dial 113, the reference plain 112 moves in the front or rear side direction as viewed in the drawing thereby to set the width of the sheet selected. In the initial stage, the sheet pressing plate 107 is set at a fixed position at the bottom of the sheet supply chamber 105. Under this condition, the cover 110 is moved from the sheet supply chamber 106 to the sheet supply chamber 105. Upon the movement of the cover 110, the sensing device 111 produces a sensing signal which in turn causes the parting plate 109 to move upward to partition the chamber into the right and left sheet supply chambers 105 and 106. At this stage, the operator stacks the sheets P in thousands and places the sheet-stack on the horizontal part of the sheet pressing plate 108. The stacked sheets P are positioned in place by the vertical part of the sheet pressing plate 108, the reference plain 112 and the parting plate 109. Then, the cover 110 is moved to close the front opening of the sheet supply chamber 106. The movement of the cover 110 is sensed by the sensor 111 and the sensor 111 produces a sensing signal which in turn causes the parting plate 109 to move downward to be below the bottom surface of the sheet supply chambers 105 and 106. And the sheet pressing plate 108 moves toward the supply chamber 105 while carrying the stacked sheets P on the horizontal part of the pressing plate 108.

At this time, the sheet pressing plate 108 is smoothly set in the sheet supply chamber 105 without being arrested by the sheet pressing plate 108 and the sheet supply chamber 105, since the bottom of the sheet supply chamber 105 and the horizontal portion of the sheet pressing plate 108 have each a number of rod-like members arranged in a drain board so as to be coupled with each other in a telescopic manner. In place of the sheet pressing plate 108, the sheet pressing plate 107 carries the stacked sheets P and goes up while carrying them to push upwardly the stacked sheets P at a given pressure. At the same time, the pressing plate 108 moves to the right side to be set at a given position in the sheet supply chamber 106. Under this set condition, by operating a start switch (see FIG. 14A) **91*b* to be given later, the rotor 114 is rotated clockwise and the absorbing chip 115 absorbs the uppermost sheet P in the sheet supply chamber 105 to take out it and to transfer the take-out one to the sheet receiving section 103. The take-out sheet P is transferred along the guide plate 117 and through the transfer path 116 to the cleaner section 104 where dust attached thereto is removed. Then, the sheet P is transferred to the sheet inspection device 200**.

While the sheets P set in the sheet supply chamber 105 are being taken out therefrom sheet by sheet by the take-out section 102, the cover 110 is moved to the sheet supply chamber 105 to supply the next sheets P onto the sheet pressing plate 108. When the cover 110 is moved to the sheet supply chamber 105, the sensor 111 senses the movement thereof to raise the parting plate 109 from the bottom surfaces of the supply chambers 105 and 106. As the sheets P are supplied to the sheet supply chamber 106, the cover 110 is returned to a fixed position, or the sheet supply chamber 106 side, so that the parting plate 109 falls below the bottom surfaces of the chambers 105 and 106. In this case, by operating a continuous take-out switch 917 (FIG. 14A) to be given later, the sheets P in the sheet supply chamber 105 is taken out and at this time the sheets P in the sheet supply chamber 106 is automatically transferred to the sheet supply chamber 105. In this way, the sheets P is continuously taken out.

INSPECTION

The sheet inspection device 200 (FIGS. 1 and 2) is comprised of an optical inspection section 201, a magnetic inspection section 202, and a mechanical inspection section 203. The optical inspection section 201 illuminates visible rays onto the incoming sheet P, and receives the reflecting light from the sheet P and the transmitted light through the sheet P to convert the received light into a corresponding electric signal thereby to sense an optical feature of the sheet P in accordance with a given logic. The magnetic inspection section 202 senses a magnetic feature of the sheet P by sensing a magnetism of the sheet P. The magnetic inspection section 202 is comprised of two magnetic heads 204 and 204, two pressure pads 205 and 205 for pressing the sheet P against the magnetic heads 204 and 204, and two holding rollers 206 and 206 disposed flush with the magnetic heads 204 and 204 to support the transfer belt of the sheet transfer/classifying device 300. To be more specific, the holding rollers 206 and 206 partially presses the transfer belt 305 toward the pressure pads 205 and 205. Further, the pressure pads 205 and 205 press the sheet P against the magnetic heads 204 and 204 thereby to make the sheet P closely contact with the head surfaces of the magnetic heads 204 and 204, whereby a good magnetic-electric conversion is ensured. The mechanical inspection section 203 inspects the thickness of the sheet P to detect the superposedly taken-out sheets or foreign sheets, and is installed fixedly. The mechanical inspection device 203 is comprised of a reference roller 207 of which the peripheral surface is invariably positioned, an oscillatory roller 208 for pressing the incoming sheet P against the reference roller 208, a sensor 209 for sensing a displacement of the oscillatory roller 208 by means of an optical means, for example. With respect to a position of the oscillatory roller 208 in a state that one normal sheet P intervenes between the reference roller 207 and the oscillatory roller 208, a displacement of the oscillatory roller 208 produced when a sheet P thicker than the above sheet intervenes therebetween. The reference roller 207 is tubular and integrally formed with a uniform peripheral surface. The oscillatory roller 208 is comprised of a plurality of small rollers disposed opposite to the reference roller 207. Specifically, regarding to the small rollers, a plurality of rollers are arranged along the axis of the reference roller 207, corresponding to the positions for sensing the thickness of the sheet P. In respect of the sensor 209, a plurality of sensors for sensing a displacement of the oscillatory roller 208 are provided corresponding to the oscillatory roller 208.

Figure 2:
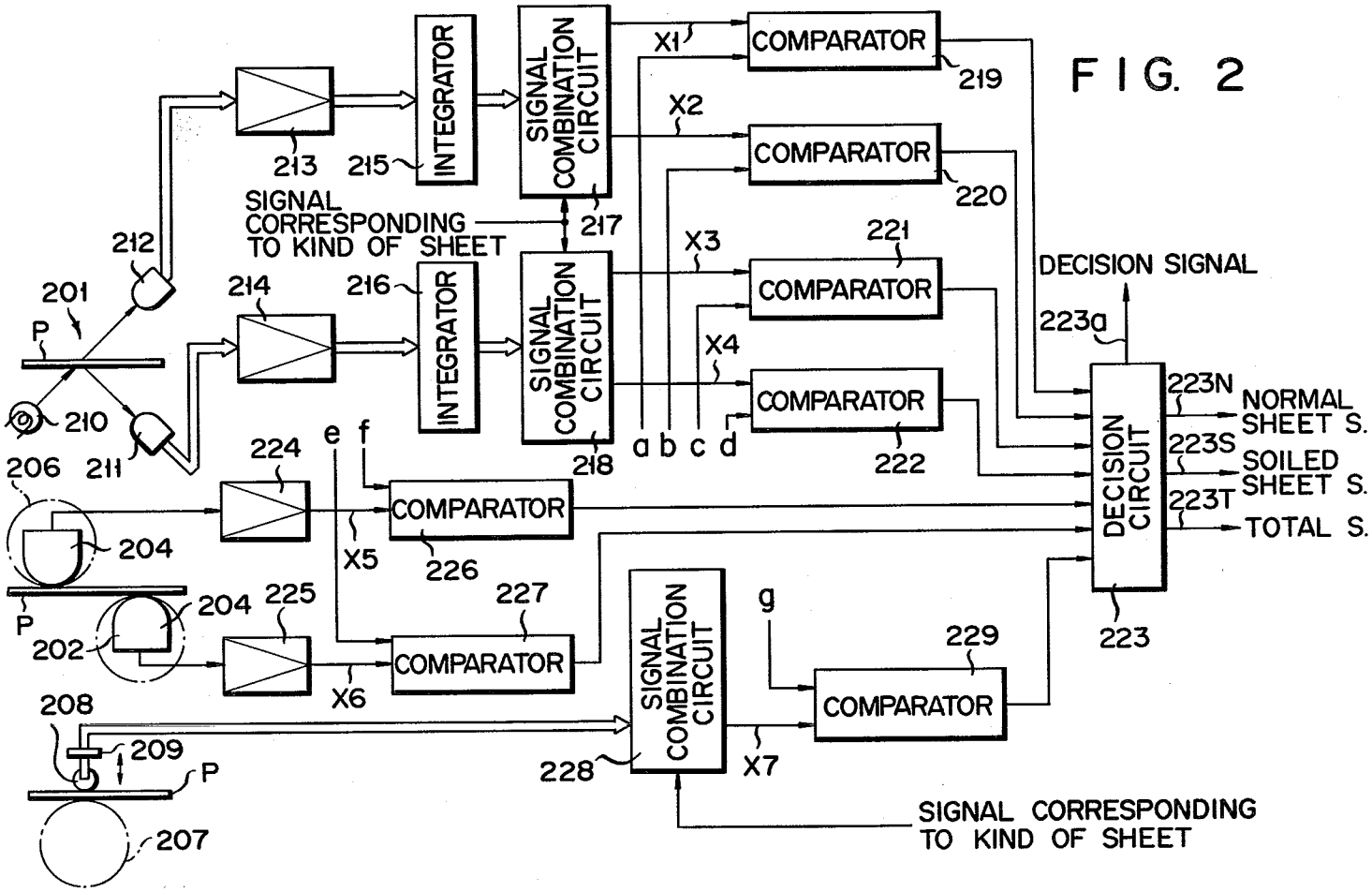
FIG. 2 is a block diagram of an inspection device used in the apparatus shown in FIG. 1.

The sheet inspection device 200 will further be described referring to FIG. 2. The optical inspection section 201 is comprised of a light source 210 for illuminating the sheet P, a light receiving element 211 for receiving the light reflecting from the sheet P, and a light sensing element 212 for receiving the light transmitted through the sheet. Actually, the light receiving elements 211 and 212 are provided at the positions for sensing an optical feature of the sheet P; however, these are illustrated generally as the receiving elements 211 and 212, for simplicity of illustration. With this arrangement, both the light receiving elements 211 and 212 convert the reflecting light and the transmitted light into corresponding electric signals, respectively. Those electric signals are transferred to the amplifiers 213 and 214, respectively. The amplifiers 213 and 214 amplify the signals from the light receiving elements 211 and 212 to given signal levels and then transfer them to integrators 215 and 216, respectively. Upon receipt of the output signals (analog signals) from the amplifiers 213 and 214, the integrators integrate for a given time and then apply them to signal combination circuits 217 and 218, respectively. In response to a sheet kind setting signal representing a kind of the sheet P to be inspected, the signal combination circuits 217 and 218 respectively combine the plurality of the output signals from the integrators 215 and 216, on the basis of a given combination. The signals produced from these combination circuits 217 and 218 are an analog signal X1 formed on the basis of transmitted light from the sheet P for inspecting a degree of dirt of the sheet P, an analog signal X2 formed on the basis of the transmitted light from the sheet P for inspecting as to if the sheet is false or not, an analog signal X3 formed on the basis of the reflecting signal from the sheet P for inspecting a degree of dirt of the sheet P, and an analog signal X4 formed on the basis of the reflecting light from the sheet P for inspecting as to if the sheet P is false or not. Those signals X1 to X4 are transferred to comparators 219 to 222 where those are compared with a, b, c and d, respectively. The reference signals a to d are analog signals having signal levels representing the kinds of the sheets P to be inspected. Of those signals, the reference signals b and d have the given widths b1 to b2, and d1 to d2, respectively. The results of the comparisons by the comparators 219 to 222 are transferred to a decision circuit 223.

The magnetic heads 204 and 204, respectively, detect the magnetism developed from the obverse and reverse sides of the sheet P, and convert them into corresponding electric signals. These electric signals converted are applied to the corresponding amplifiers 224 and 225, respectively. The amplifiers 224 and 225 amplify the signals derived from the magnetic heads 204 and 204 to given signal levels, respectively. Those amplified signals X5 and X6 are further applied to the comparators 226 and 227. Upon receipt of those signals, the comparators 226 and 227, respectively, compare those signals with the reference signals e and f. The reference signals e and f are analog signals with the levels corresponding to a kind of sheets to be processed and have the given widths e1 to e2 and f1 to f2, respectively. The results of the comparisons by the comparators 226 and 227 are transferred to the decision circuit 223.

The oscillatory roller 208 responds to the thickness of the sheet P to be inspected to displace vertically. A displacement in excess of a given value causes the sensor 209 to operate, with a recognition that the sheets P are superposedly taken out and a foreign sheet is present. As a result, the sensor 209 produces a sensing signal corresponding to the displacement, which in turn is transferred to the signal combination circuit 228. The signal combination circuit 228 as a kind of a gate circuit responds to the sheet kind setting signal to combine the signals from the sensor 209 on a given combination and to produce the analog signal X7 representing the thickness of the sheet P. The signal X7 is transferred to the comparator 229 where it is compared with a reference signal g which is an analog signal with a level inherent to the kind of the sheet P to be inspected and has a width ranging between g1 to g2. In this way, the comparator 229 transfers the comparison result as a signal representing an abnormal thickness of the sheet P to be inspected (for example, the superposedly taken out sheet or the foreign sheet) to the decision circuit 223.

The reference signals a to g are generated from a reference signal generator (not shown), corresponding to the respective sheet kinds setting signals. The reference signal generator may be an analog memory for selectively producing an analog signal in accordance with the sheet kind setting signal or the combination of a fixed memory addressed by the sheet kind setting signal and a D/A converter for converting a digital signal derived from the fixed memory into an analog signal. The sheet kind setting signal is produced when the sheet setting dial 113 (FIGS. 1 and 2) is operated and indicates what kind of sheet P is now processed by the apparatus now.

The decision circuit 223 decides the sheet P as in the following table on the basis of the comparison results of the comparators 219, 220, 221, 222, 226, 227 and 229.

TABLE

| DECISION PRIORITY | SHEET CLASSIFICATION | | CONDITIONS TO BE SATISFIED |
|---|---|---|---|
| 1 | SHEETS TO BE REJECTED | INVALID SHEET | X2>b2, OR 61>X2, OR X4>d2, OR d1>X4, OR X5>e2, OR X5<e1, OR X6>F2, OR X6<f1 |
| | | OVERLAPPED SHEET FOREIGN SHEET | X7>g2, OR X7<g1 |
| 2 | SOLID SHEET | | b1≦X2≦b2, AND d1≦X4≦d2, AND e1≦X5≦e2, AND f1≦X6≦f2, AND g1≦X7≦g2, FURTHER X1<a OR X3<C |
| 3 | NORMAL SHEET | | X1≧a, AND b1≦X2≦b2, AND X3≧C, AND d1≦X4≦d2, AND e1≦X5≦e2, AND f1≦X6≦f2, AND g1≦X7≦g2 |

The decision circuit 223 judges the sheets P to decide the classes of the sheets P and produce various signals; a decision signal 223*a*, a soiled sheet signal 223S representing a soiled sheet, a normal sheet signal 223N representing a normal sheet, and a total signal 223T representing the total of the normal and soiled sheets. The decision signal 223*a* is used as a transfer and classifying control signal of the sheets P. The soiled, normal and total signals 223N, 223S and 223T are used as count signals respectively. The respective signals derived from the decision circuit 223 are transferred to a control device (FIGS. 14A and 14B) to be described later.

TRANSFER AND CLASSIFYING

The transfer and classifying device 300 (see FIG. 1) is mainly comprised of a first transfer path 301, a second transfer path 302, and a third transfer path 303. Those transfer paths includes each drive or follower rollers 304, 304, . . . and transfer belts 305, 305, . . . wound around those rollers. The transfer sheet P is nipped by the surfaces, confronting with each other, of the transfer belts 305, 305, . . . , and is transferred to the succeeding stage. The first transfer path 301 extends through the sheet receiving section 103, the sheet cleaner section 104 and the sheet inspection device 300. The second transfer path 302 is provided at its branching point with a first classifying gate 306. The first classifying gate 306, so designed to swing when it is driven by a rotary solenoid (not shown), guides the sheet P transferred from the inspection device 200 in response to the decision signal 223*a* (FIG. 2) to the second transfer path 302 or the third transfer path 303. A detector such as an optical detector is provided preceding to the first classifying gate 306. The detector 307 detects the sheet P transferred through the first transfer path 301 and produces a detecting signal. At the time that the detecting signal is produced, the first classifying gate 306 is swung.

The end portion of the second transfer path 302 is positioned above the sheet supply section 101. At the end portion, a rejected sheet pile-up section 308 is provided which includes a guide plate 309 coupled with the end portion of the second transfer path 302, a sheet pile-up or stacking box 310 for piling up or stacking rejected sheets P falling guided by the guide plate 309, and a door 311 for opening and closing the front opening of the sheet stacking box 310. The third transfer path 303 is comprised of a normal sheet transfer path 303*a* and a soiled sheet transfer path 303*b*. At the branching point of both the transfer paths 303*a* and 303*b*, a second classifying gate 312 is provided. The second classifying gate 312, constructed like the first classifying gate 306, responds to the decision signal 223*a* (FIG. 2) to guide the sheet P transferred from the inspection device 200 to the normal sheet transfer path 303 or the soiled sheet transfer path 303*b*. Also preceding to the second classifying gate 312 is provided an optical, for example, detector 313. The detector 313 detects the sheet P transferred through the third transfer path to produce a detecting signal. At the timing of the production of the detecting signal, the second classifying gate 312 is swung. The normal sheet transfer path 303*a* extends up to a normal unit sheet-stack forming device 400*a*. An optical, for example, detector 314 is provided on the sheet take-in side of the unit sheet-stack forming device 400*a*. The soiled sheet transfer path 303*b* likewise extends up to the soiled unit sheet-stack forming device 400*b* and an optical, for example, detector 315 is installed at the sheet taken-in port side of the unit sheet-stack forming device 400*b*. The detectors 314 and 315 detect the number of the sheets P transferred into the unit sheet-stack forming devices 400*a* and 400*b* and the timing of the sheet transfer. The detail of those unit sheet-stack forming devices will subsequently be described referring to FIG. 3.

Figure 14:
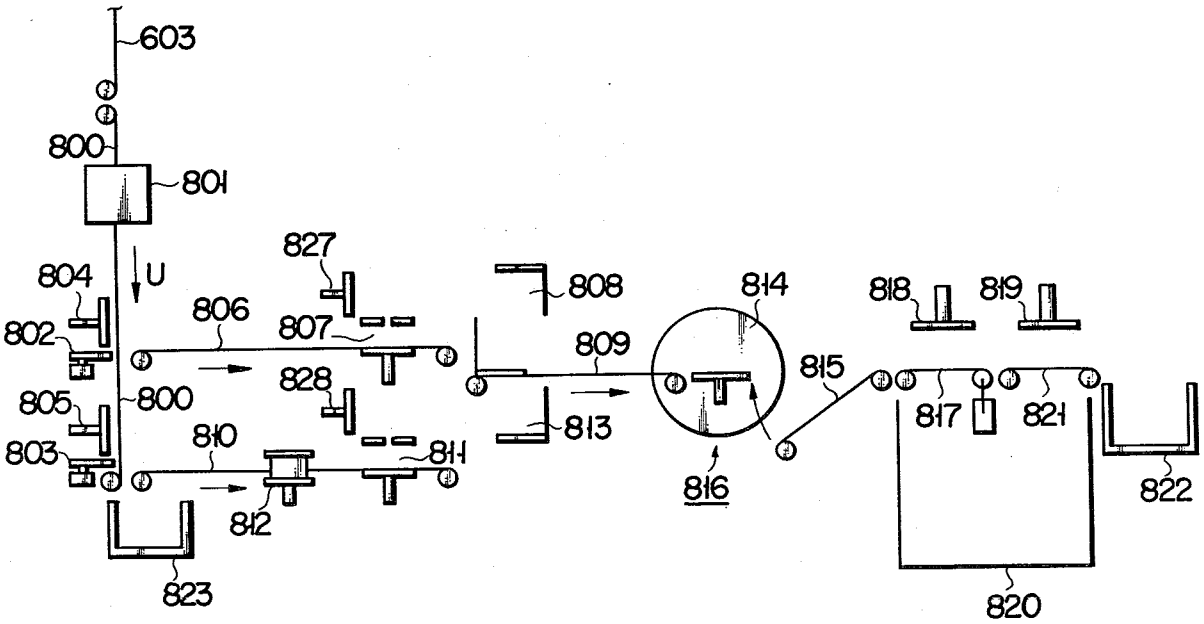
FIG. 14 is a schematic diagram of the apparatus shown in FIG. 13.
Figure 15A:
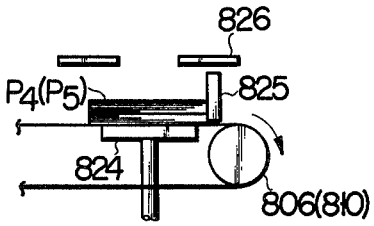
FIGS. 15A to 15H are series of diagrams useful in explaining the operation and the construction of a normal sheet bundle correcting device (a soiled sheet bundle correcting device)
Figure 15B:
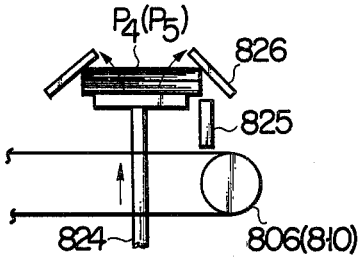
Figure 15C:
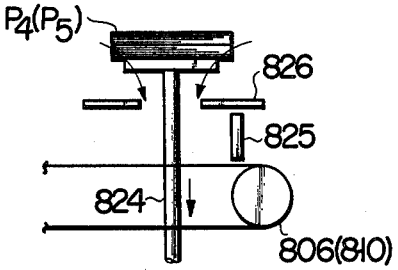
Figure 15D:
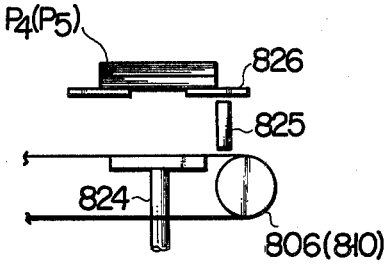
Figure 15E:
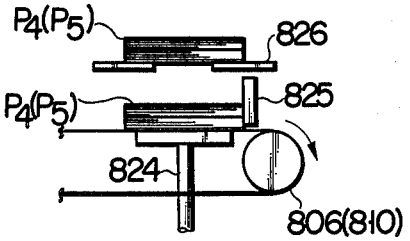
Figure 15F:
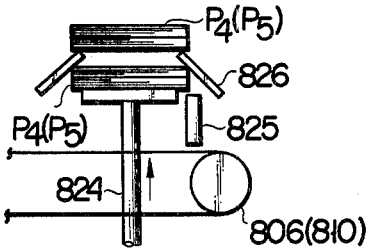
Figure 15G:
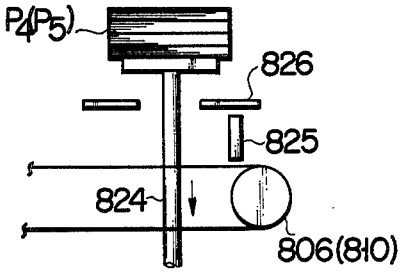
Figure 15H:
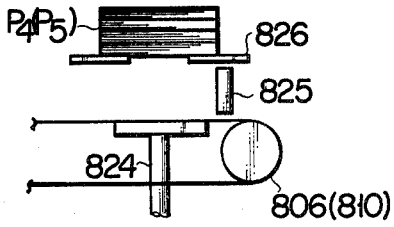

The operation of the sheet transfer and classifying device 300 will be described in detail. The sheet P taken out by the sheet take-out/transfer device 100 is transferred to the transfer classifying device 300, through the sheet receiving section 103. Specifically, the sheet P is transferred from the sheet receiving section 103 to the first sheet transfer path 301. During the time period that the sheet travels on the first sheet transfer path, the sheet P is inspected by the inspection device 200 and the judging result or decision signal 223*a* (FIG. 2) corresponding to the class of the sheet P is produced from the decision circuit 223 (FIG. 2). The decision signal 223*a* is transferred to a control device (FIGS. 14A and 14B) to be described later. As the sheet P transferred is detected by the detector 307, the signal from the detector is applied to the control device (FIG. 14). Upon receipt of the decision signal 223*a* from the decision or judging circuit 223 (FIG. 2), the control device causes the first classifying gate 306 to swing. The first classifying gate 306, so set as to guide the sheet P to the third transfer path 303, holds the state set when the decision signal 223*a* from the decision circuit 223 represents a normal or a soiled sheet, and swings so as to guide a rejected sheet P to the second transfer path 302 when the decision signal 223*a* represents a rejected sheet at the timing that the sheet P is detected. The sheet P guided to the second transfer path 302 is accommodated in the sheet pile-up box 310 of the rejected sheet stacking section 308. The sheets P stacked or piled up in the box 310 may be taken out to exterior by opening the door 311.

When the sheet P is guided to the third transfer path 303 and detected by the detector 313, a detecting signal is produced by the detector and is transferred to the control device (FIGS. 14A and 14B). The control device causes the second classifying gate 312 to swing in response to the decision signal 223*a* from the decision circuit 223. Specifically, the second classifying gate is set in a normal condition so as to guide the sheet P to the normal sheet transfer path 303*a*. When the decision signal 223*a* represents a normal sheet, such a set condition is held as it is. When the decision signal 223*a* represents a soiled sheet, the second gate is rotated so as to guide the sheet P at the timing of the detection of the sheet P.

Though not illustrated, optical jam detectors are provided with given intervals in the transfer/classifying device 300. The jam detectors detect the presence or absence of the passing sheet P thereby to check jam and the drop-out of the sheet from the sheet transfer path.

UNIT SHEET-STACK FORMING

The unit sheet-stack forming device 400 includes the normal unit sheet-stack forming device 400*a*, and the soiled unit sheet-stack forming device 400*b*, as mentioned above. Since both the devices have the same constructions, only the normal unit sheet-stack forming device 400*a* will be described hereinafter.

Figure 3:
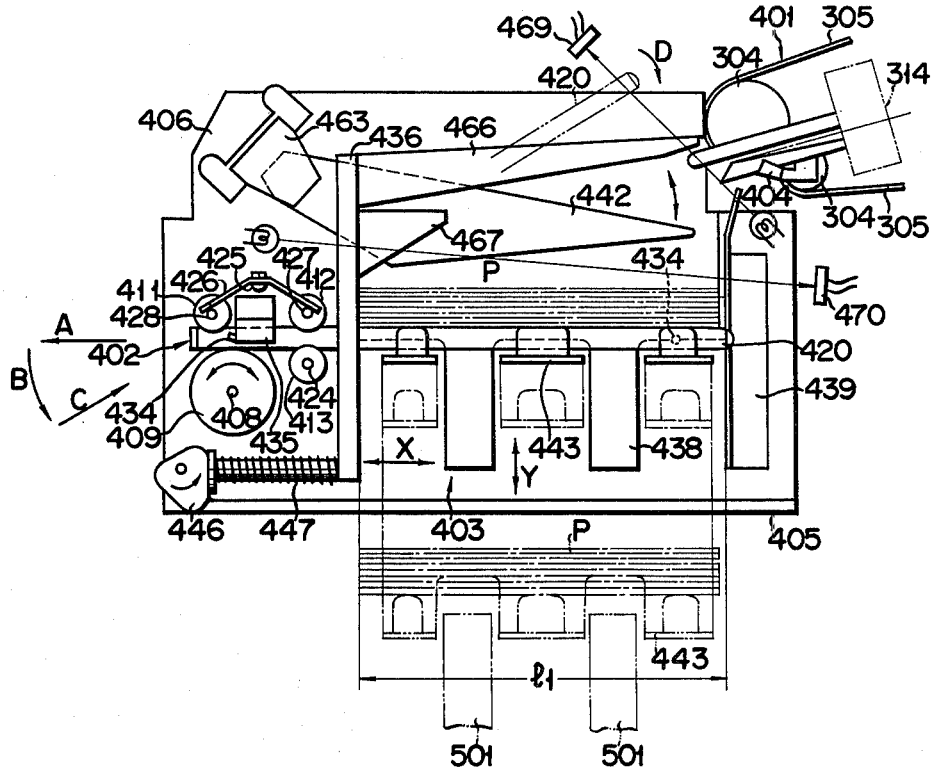
Figure 4:
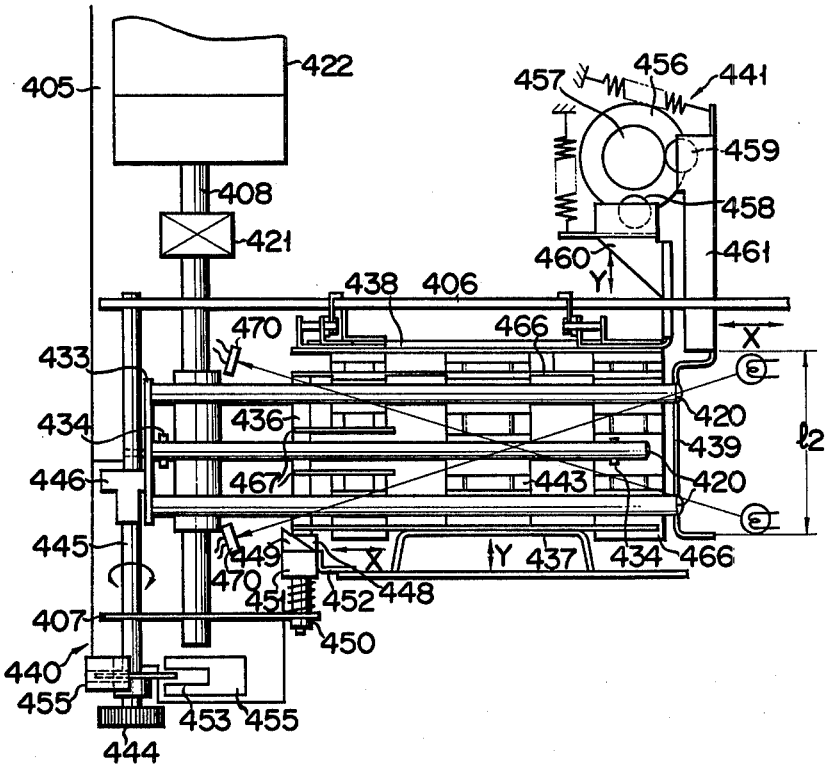

The normal unit sheet-stack forming device 400*a* is illustrated in FIGS. 3, 4, 5 and 6 which are a front view, a plan view, a side view and a part of the front view, respectively. The device 400*a* are roughly divided into a sheet take-in section 401, a separator 402, and a stack forming section 403 (FIG. 3). The sheet taken-in section 401 is comprised of a detector 314 for detecting the sheet P transferred from the normal sheet transfer path 303*a* (FIG. 1), a roller 304 for transferring the sheet P, a transfer belt 305 wound around the roller, and a charge remover 404 for removing the charge charged on the sheet P through the slide of it along the sheet P. The detector 314 detects the passing of the sheet P to detect the number of the sheets passed and the timing of the transferring sheet taken in. The roller 304 and the transfer belt 305 constitute a part of the normal sheet transfer path 303*a*. The normal unit sheet-stack forming device 400*a* is supported by subplates 406 and 407 upstanding from a base member 405. The separator 402 is comprised of a drive roller 409 mounted to a shaft 408 supported by the subplates 406 and 407 (FIG. 4), follower rollers 411 to 419 (FIG. 5) supported by brackets 410 and 410 (FIG. 5), three separator arms 420 (FIG. 4) nipped by the drive roller 409 and the follower rollers 411 to 419. The shaft 408 is rotatably coupled with a motor 422 (FIG. 4) through a coupling 421 (FIG. 4). Grooves 423 (FIG. 5) for stably supporting the separator arms 420 are formed on the peripheral surface of the drive roller 409. Similarly, grooves are formed on the peripheral surfaces of the follower rollers 411 to 419.

Figure 5:
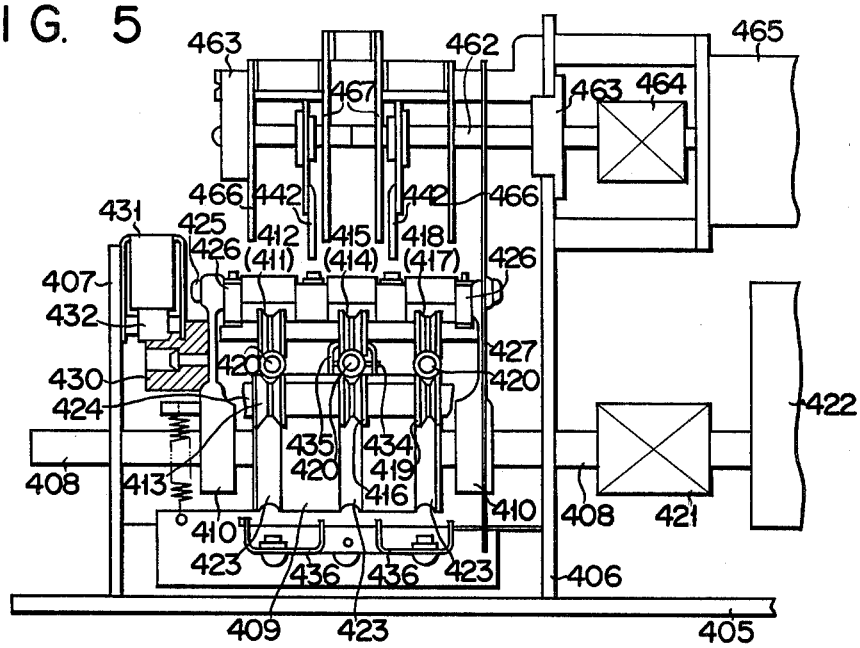
Figure 6:
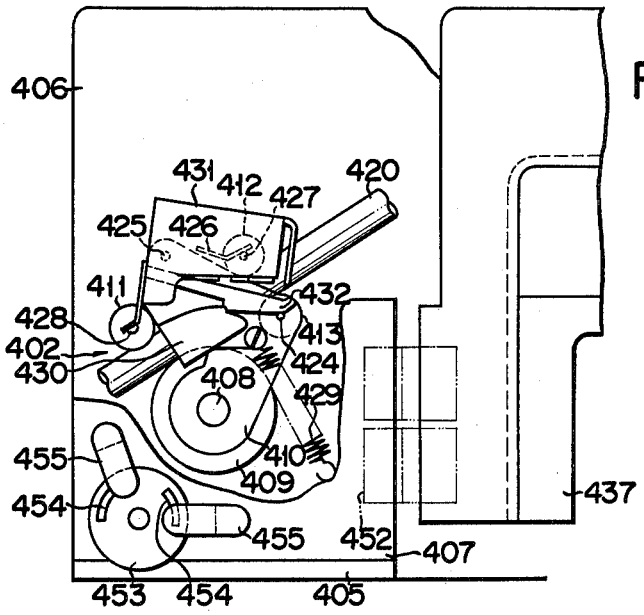

The brackets 410 and 410 (FIG. 5) are supported by the shaft 408, allowing the brackets to be rotatable about the shaft 408. A shaft 424 (FIG. 5) is bridged between the brackets 410 and 410 and rotatably supports the follower rollers 413. Above the shaft 424 (FIG. 5) a shaft 425 is bridged between the brackets 410 and 410. Four curved plate springs 426 (FIG. 5) are rotatably mounted to the shaft 425. Shafts 427 and 428 (FIG. 6) are fixed to both ends of each plate spring 426. The follower rollers 412, 415 and 418 are rotatably mounted to the shaft 427 and the follower rollers 411, 414 and 417, to the shaft 428. Thus, the brackets 410, 410 and the plate springs 426, 426, . . . are rotatable and therefore the follower rollers 411, 412, 414, 415, 417 and 418 are swingable with respect to the drive roller 409, and the follower rollers 413, 416 and 419. The brackets 410 are normally biased toward the base member 405 by means of a coiled spring 429 (FIG. 6). Further, to the brackets 410, a pawl 430 (FIG. 6) is screwed. The pawl 430 engages an armature 432 which is moved by the attraction or the release by the solenoid 431 (FIG. 6), when the brackets 410 are rotated counterclockwise against the tension of the spring 429.

The separate arms 420 (FIGS. 5 and 6) as metal bars has one end curved and the other end fixed to the plate 433 (FIG. 4). Of those three separate arms 420, the central arm 420 is provided at the forward and backward ends with stopper pins 434 and 434 as well illustrated in FIGS. 3 and 4. The stopper pins 434 defines the movable range of the separator arms 420. The stopper pins 434 are fixed by means of fixing members 435 (FIG. 5).

Included in the unit sheet-stack forming section 403 (FIG. 3) are: slide stoppers 436 as the respective side walls, a door 437 (FIG. 4), a first vibrating plate 438, a second vibrating plate 439, a mechanism 440 (FIG. 4) for changing a sheet stacking capacity by moving the slide stopper 436 and the door 437, a vibrating mechanism 441 (FIG. 4) for vibrating the first and second vibrating plates 438 and 439, beating members 442 and 442, and a back-up member or back-up plate 443 (FIG. 3) serving as the bottom, and the like. The mechanism 440 for changing the sheet stacking capacity (FIG. 4) changes the sheet stacking capacity in accordance with the size of the sheet P to be processed. When the sheet to be processed is set to a given size by rotating a knob 444 (FIGS. 4 or 14), a cam 446 fixed to the shaft 445 (FIG. 4) coupled with the knob 444 rotates, so that the slide stopper 436 moves through a moving member 447 in an X direction arrowed (FIG. 4), thereby to obtain a given length $l_1$ (FIG. 3) in the longitudinal direction (longer side) of the sheet P. Also when the slide stopper 436 moves, a cam 448 fixed to the stopper 436 is also moved in the arrowed X direction (FIG. 4). With the movement of the cam 448, a cam follower 449 moves in an arrowed Y direction (FIG. 4). The cam follower 449 is fixed to a block 451 which slides along the shaft 450.

The block 451 is coupled with the door 437, through a hinge 452. Therefore, the door 437 (FIG. 4) moves in the Y direction with the movement of the cam follower 449, thereby to obtain a given length $l_2$ in the shorter side (width) direction of the sheet P.

Fixed to the shaft 445, is a disc 453 for detecting the size set of the sheet, as denoted by 453 (FIGS. 4 and 6). The disc 453 has slits 454 (FIG. 6) on the peripheral surface. Those slits 454 are detected by detectors 455 disposed around the disc 453, optically. The respective output signals from the detectors 455 are transferred to the control device shown in FIGS. 14A and 14B whereby the size of the sheet P, as set, is detected.

The vibrating mechanism 441 (FIG. 4) vibrates the first and second vibrating plates 438 and 439 to arrange the stacked sheets properly. To be more specific, the motor 456 (FIG. 4) rotates an eccentric cam 457 which in turn drive cam followers 458 and 459, so that the coupling members 460 and 461 fixed to the cam followers 458 and 459 are swung in the arrows X and Y. The first vibrating plate 348 and the second vibrating plate 439 are coupled with the coupling members 460 and 461, respectively. Accordingly, the first vibrating plate 438 vibrates in the Y direction with the swing of the coupling member 460 and the second vibrating plate 439 vibrates in the X direction with the swing of the coupling member 561.

The beating plates 442 and 442 (FIG. 3), fixed to the shaft 462 (FIG. 5), are used to slap the sheet P incoming through the transfer section 401 to let it fall. The shaft 462 is supported by housings 463 and coupled with a rotary solenoid 456 through a coupling member 464. The beating members 442 and 442 are swung with a given stroke by means of the solenoid (FIG. 5). Reference numerals 466 and 466, and 467 and 467 are guide members for guiding the incoming sheet P, which are fixed to the upper end of the slide stopper 436. The slide stopper 436 and the beating members 442 and 442 are coupled in a telescopic manner between the housings 463 and 463 (FIG. 5). The guide members 466, 466, 467 and 467 are moved in the X direction (FIG. 4) with the movement of the slide stopper 436 (FIG. 5). The back-up member or the back-up plate 443 are shaped like an inverse L. The horizontal portion of the inverse L is divided into three. The back-up plate 443, disposed under the separator 402 (FIG. 3), piles up thereon the sheets P and is movable up and down, if necessary.

The operation of the normal unit sheet-stack forming device 400*a* thus far described in detail relating to its construction will be given. The sheet P coming in through the sheet take-in port is successively guided by the guide members 466, 466, 467 and 467, and is beaten to drop by the beating members 442 and 442, so that those sheets P are piled up on the separator 402 disposed within the unit sheet-stack forming section 403, successively. When the sheets P approximate to the given number are piled up on the separator 402, the separator 402 retards in an arrowed direction A (FIG. 3). Specifically, the motor 422 (FIG. 4) operates to rotate the drive roller 409, so that the separator arms 420, 420 and 420 (FIG. 3) move to the left, or in the arrowed direction A in FIG. 3. After the separator 402 retards, the sheets P piled up in the separator are dropped due to their own weights on the back-up plate 443 which has been lifted to a position indicated by a continuous line and ready for receiving the falling sheets. At this time, the separator 402, which retarded in the arrowed direction A, swings counterclockwise i.e. in the arrow direction B, to change its angle. Afterwards, it advances in the arrow direction C and retards to a position (FIG. 3) indicated by a two-dot chain line and is on stand-by. That is, when the separator arms 420, 420 and 420 (FIG. 4) move in the arrow direction A and the stopper pin 434 provided at the end comes in contact with the engaging member 435, the separator arms 420, 420, 420 and 420 swing in the arrow direction B. The swing is stopped to be locked when the pawl 430 (FIG. 6) engages the armature 432. Upon the locking those separator arms 420, the drive roller 409 rotates, so that the separator arms 420, 420, 420 and 420 move in the arrow direction C. Then, when the stopper pin 434 comes to engage the engaging member 435, the drive roller 409 stops its rotation.

In this way, when the sheets P approximate to the given number (, for example, 100) are piled up on the back-up member 443, the back-up member 443 descends to the position (FIG. 3) indicated by one-dot chain line. Then, when the given number of sheets P is stacked on the back-up plate 443, the separator 402, which has been on stand-by above the unit sheet-stack forming section 403, rotates clockwise, i.e. in the arrow direction D to stop again at the position indicated by a continuous line. Specifically, when the 100th sheet P is detected by the detector 314, the control device shown in FIG. 24 receives a detecting signal from the detector 314 to apply a drive signal to the solenoid 431 (FIG. 5), so that the engagement of the armature 432 with the pawl 430 is released. Therefore, the separator arms 420, 420 and 420 are unlocked and the tension of the spring 429 (FIG. 6) causes the separator arms to drop (rotate). Accordingly, the sheet P on the back-up plate 443 is perfectly separated from the successively transferred sheets P, by means of the separator 402. The number of the sheets P stacked on the back-up plate 443 is counted by the control device shown in FIG. 24 on the basis of the output signal from the detector 314. Whether those sheets P are separated into the given number of them or not is optically checked by the detectors 469, 470 and 470 (FIGS. 3 and 4). In other words, when the detector 469 detects the 101st sheet P, if the detectors 470 and 470 (FIG. 4) have been changed from "dark" to "bright", it is assumed that the sheets P have been separated with an accuracy of the given number of sheets. The back-up plate 443 descends from the position indicated by the one-dot chain line to the position (FIG. 3) by the two-dot chain line, while bearing the given number of the stacked sheets P. The sheet-stack will be called a unit sheet-stack. Then the unit sheet-stack is transferred to rotatable drums 501 and 501 (FIG. 7) of the unit sheet-stack bundling device 500 (FIG. 1). After the transfer of the unit sheet-stack, the back-up plate 443 ascends again up to the position indicated by the continuous line (FIG. 3).

UNIT SHEET-STACK BUNDLING

As described above, the unit sheet-stack bundling device 500 includes a normal unit sheet-stack bundling device 500*a* and the soiled unit sheet-stack bundling device 500*b*. Since both the devices have the same constructions, the description will be given only about the normal unit sheet-stack device 500*a*.

Figure 7:
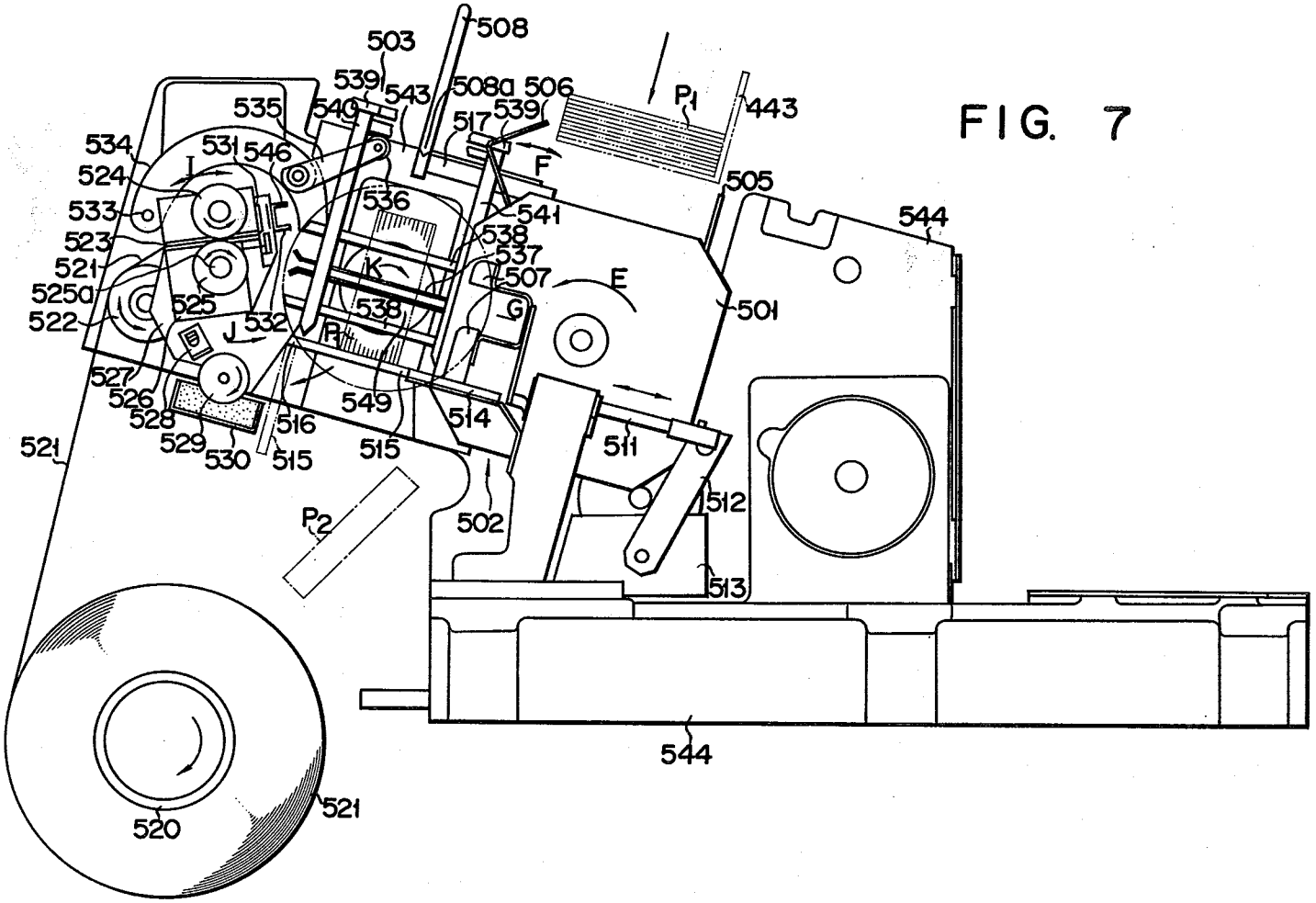
Figure 8:
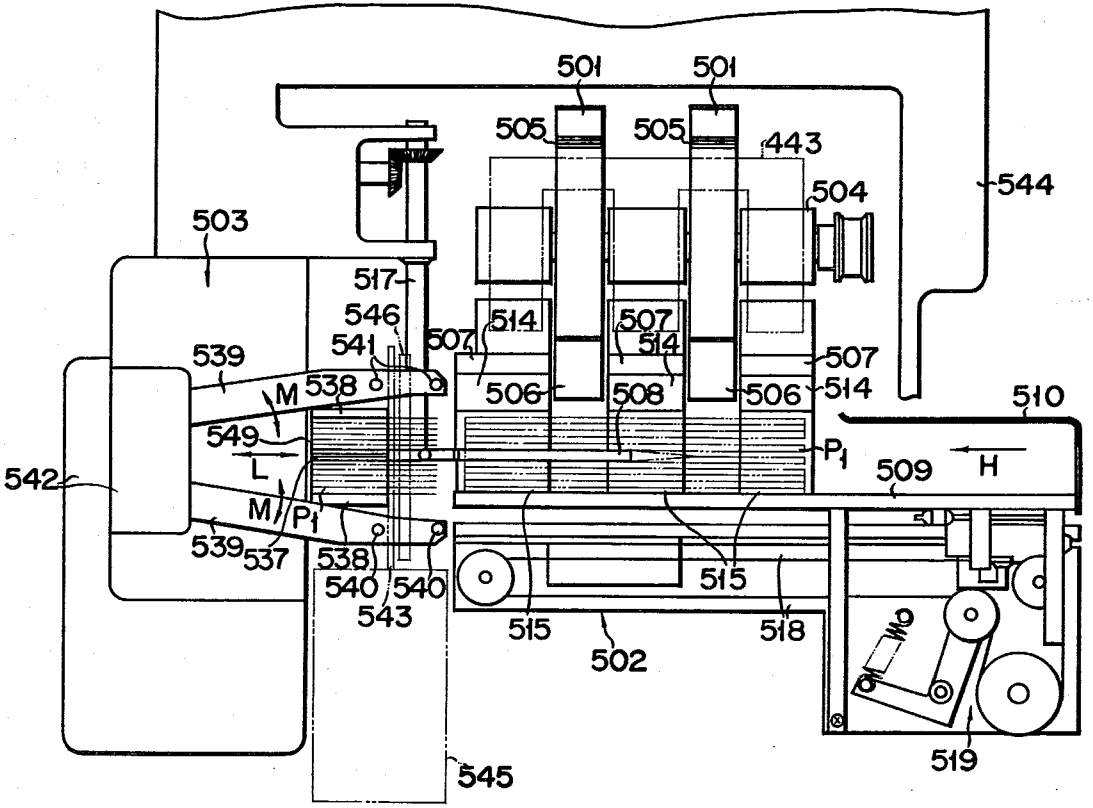

The normal unit sheet-stack bundling device 500*a* shown in FIGS. 7 and 8 is comprised of a transfer mechanism for transferring the unit sheet-stack to a given position, a bundling loop forming mechanism for forming a bundling tape loop for bundling the unit sheet-stack, and a bundling mechanism for inserting the unit sheet-stack into the loop and bundling the unit sheet-stack. The transfer mechanism includes a pair of the rotatory drums 501 and 501. The bundling loop forming mechanism, the bundling mechanism 503 and an inserting mechanism 502 for inserting the unit sheet-stack into the loop are illustrated in FIG. 7. The rotatory drums 501 and 501, disposed under the back-up plate 443 of the normal unit sheet-stack forming device, receives the given number of sheets P transferred in a substantially horizontal state by the back-up member 443, the unit sheet-stack P1, and rotates the unit sheet-stack counterclock, i.e. in the arrow direction E by approximately 90° thereby to set the unit sheet-stack, i.e. the respective sheets, in substantially vertical state. Specifically, the respective rotatory drums 501 and 501 are so designed that those are shaped substantially square with a given thickness and are mounted to a shaft 504 (FIG. 8) at given intervals. When the shaft 504 is rotated by a drive source (not shown), the drums are rotated in the arrow direction E. Fixing plates 505 and inverse L shaped movable holding plates, or clamp members 506, upstand on the peripheral surfaces of the drums 501 and 501. The clamp members 506, so designed as to open and close in the arrow direction F, opens when the unit sheet-stack P1 is to be received, and closes when the unit sheet-stack P1 is received, whereby the unit sheet-stack P1 is clamped in the stacking direction by means of the fixing plate 505 and the clamp member 506. The rotatory drums 501 and 501 are coupled with the horizontal section of the back-up member 443 in a telescopic manner, when the back-up member 443 descends from the unit sheet-stack forming device 400*a*.

The unit sheet-stack shift mechanism 502 divides the unit sheet-stack P1 disposed by the rotatory drums 501 and 501 into first and second sub-unit sheet-stacks at the central portion of the unit sheet-stack as viewed in the stacking direction. Then, the mechanism transfers or shifts the divided ones to the bundling tape loop forming/bundling mechanism. The unit sheet-stack shift mechanism 502 is comprised of a pushing member 507, a dividing plate 508, a guide wall 509, and a feed arm 510. The pushing member 507 is coupled with the drive section 513, through a push bar 511 and an arm 512. When the drive section 513 is operated, the pushing member 507 moves in the arrow direction G (FIG. 7), through the arm 512 and the push bar 511. The pushing member 507 pushes the unit sheet-stack P1 substantially vertically clamped on the drums 501 and 501 along the fixed bottom plate 514 and the movable bottom plate 515 till the stack reaches the guide wall 509. The pushing member 507, the fixed bottom plate 514, and the movable bottom plate 515 are divided into three and, of those, the pushing member 507 and the fixing bottom plate 514 are telescoped with the rotatory drums 501 and 501 (FIG. 8).

The bundling loop forming/bundling mechanism 503 turns the free end portion of the bundling tape fed from the bundling tape supply source by a given number of turns thereby to form a bundling tape loop. Within the loop, the free end of the tape is suspended so as to divide the space within the loop into two sections. Into the bundling loop, the unit sheet-stack P1 is inserted by means of the unit sheet-stack shift mechanism 502 thereby to push up the loop to bundle the unit sheet-stack. The bundling loop forming/bundling mechanism 503 is provided on the left end portion (FIG. 8) of the sheet-stack shifting mechanism 502. The bundling tape wound around a reel 520 (FIG. 7) of the tape supplier, for example, a green paper tape 521 (a yellow paper tape is used for the soiled unit sheet-stack bundling) is led to a tape guide path 523 through a tape guide roller 522. In the middle way of the guide path 523, the paper tape 521 is nipped by a pair of tape feeding rollers 524 and 525 and is fed forward. The guide path 523 and the feeding rollers 524 and 525 are provided on a roller supporting member 526. The roller supporting member 526 rotates in the arrow direction I about the shaft 525*a* of the feeding roller 525, if necessary.

On the forward portion of the roller supporting member 526, or on the right side in FIG. 7, a tape guide member 537 is provided into which the leading end of the tape 521 fed by the feeding rollers 524 and 525 is inserted by a given length thereof. A pair of unit sheet-stack guides 538 and 538 provided in parallel on both sides of the guide member 537 are used for guiding the unit sheet-stack P1 transferred by the transfer arm 510 (FIG. 8). These guide members 537, 538 and 538 are fixed to a guide member drive disc 549 and are rotated in the arrow direction K or moved in the arrow direction L as required by means of the disc 549. A pair of clamp drive arms 539 and 539 are disposed above the guide members 537 and 538 (FIG. 8). At the ends of those arms 539 and 539, pairs of clamp bars 540, 540, 541 and 541 are suspended in parallel at given intervals. The arms 539 and 539, coupled at the rear ends or the left ends in FIG. 8, with the drive section 542, are opened and closed in the arrow direction M by means of the drive section 542, if necessary. At the time closing, the unit sheet-stack P1 transferred by the feeding arm 510 (FIG. 8) is clamped by the pairs of the clamp bars 540 and 540, and 541 and 541.

In FIGS. 7 and 8, reference numeral 543 designates a tape insertion preventive plate shaped like an inverse U. The preventive plate 543 is provided at the portion corresponding to the ends of the sheet guide members 538 and 538, substantially upright. Reference numeral 544 in FIGS. 7 and 8 indicates a base member of the apparatus. A portion 545 enclosed by a two-dot chain line indicates a portion where the respective components 521 to 536 in FIG. 7 are located.

The operation of the normal unit sheet-stack bundling device 500*a* will be described referring to FIGS. 9A to 9F, and FIGS. 10A to 10I. The rotatory drums 501 and 501 are normally at a standstill in a state shown in FIG. 9A, waiting the receiving of the unit sheet-stack P1. At this time, the clamp members 506 are in a closed condition. Under this condition, if the back-up member 443 bearing the unit sheet-stack (including 100 sheets stacked, for example) descends, the clamp member 506 corresponding to the back-up member 443 opens for receiving the sheet-stack, as shown in FIG. 9A. The back-up member 443 further descends and temporarily stops when the horizontal portion of the back-up member 443 is telescoped with the rotatory drums 501 and 501, as shown in FIG. 9B. In this way, the unit sheet-stack P1 on the back-up member 443 is transferred onto the peripheral surfaces of the rotatory drums 501 and 501. When the unit sheet-stack P1 is transferred to the rotatory drum 501, the clamp member 506 is closed as shown in FIG. 9C to clamp the unit sheet-stack P1 and the drums 501 and 501 start to rotate in the arrow direction E, while at the same time the back-up member 443 ascends. When the rotatory drums 501 and 501 are rotated by about 90 degrees clockwise, as shown in FIG. 9D, the rotatory drums 501 and 501 temporarily stop thereat and the clamp member 506 opens again. At this time, the lower end surface of the unit sheet-stack P1 is directed substantially horizontally with respect to the fixed bottom plate 514, as shown in FIG. 9D. And the unit sheet-stack P1 is transferred onto the bottom plate 514, with the sheets being disposed substantially vertically. In this way, the unit sheet-stack P1 received from the back-up member 443 while being substantially in horizontal state is rotated by about 90° in the arrow direction E to be postured substantially vertically. In this way, the rotatory drums 501 and 501 stop the rotation and the clamp member 506 opens. Succeedingly, the drive section 513 (FIG. 7) operates with the result that the pushing member 507 advances in the arrow direction G, as shown in FIG. 9D to push the unit sheet-stack on the fixed bottom plate 514 to come in contact with the guide wall 509, as shown in FIG. 9E. At this position, the pushing member 507 temporarily stops. Accordingly, the pushed unit sheet-stack P1 is positioned on the movable bottom plate 515 in the substantial vertical posture, as shown in FIG. 8.

Then, when the back-up member 443 carrying the next unit sheet-stack P1 descends again, the unit sheet-stack is transferred to another peripheral surface of the rotatory drums 501 and 501, through the above-mentioned operation, as shown in FIGS. 9D and 9E.

Figure 10A:
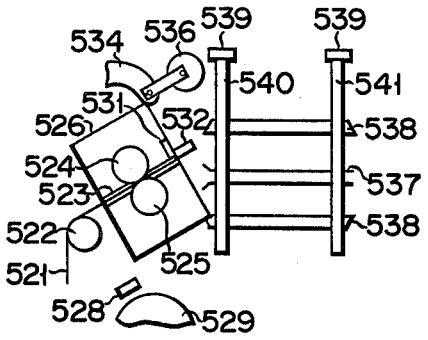
FIGS. 10A to 10I illustrate a bundling tape loop forming mechanism (FIGS. 10A to 10C) in the unit sheet-stack bundling device shown in FIGS. 7 and 8 and a unit sheet-stack bundling mechanism (FIGS. 10D and 10I) of the same.
Figure 10B:
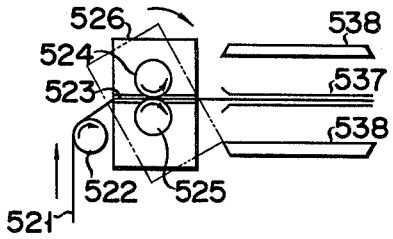
Figure 10C:
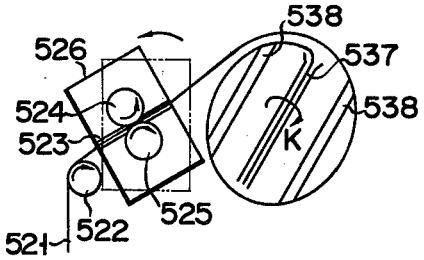
Figure 10D:
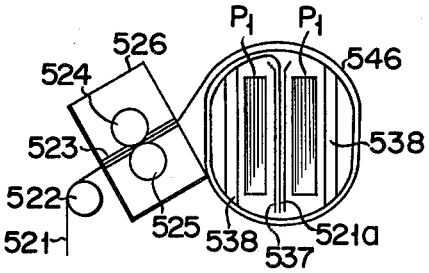

When the pushing member 507 temporarily stops as shown in FIG. 9E (or when the pushing member 507 starts to advance), the bundling loop forming/bundling mechanism (FIG. 8) 503 starts the bundling loop formation. The construction and operation of the bundling loop forming/bundling mechanism 503 will be described. In FIGS. 7, 8 and 10A, a roller receiving member 526, a paste pad 528, a squeeze roller 536, a tape guide member 537, unit sheet-stack guide members 538 and 538, and clamp bars 540, 540, 541 and 541 are stopped in the state shown in FIG. 10A, or in the state of FIGS. 7 and 8, and is ready for the start of the operation. Under this condition, when the bundling loop formation command is issued, the roller receiving member 526 rotates clockwise as shown in FIG. 10B and the outlet (end) of the guide path 523 temporarily stops at the position facing the inlet of the tape guide member 537. When the roller receiving member 526 stops, the feeding rollers 524 and 525 rotate in the tape feeding direction, so that the tape 521 is fed and the leading end portion of the tape is inserted into the guide member 537 by the given length, as shown in FIG. 10B. When the leading end portion of the tape is inserted into the tape guide member 537, the receiving member 526 rotates counterclockwise, as shown in FIG. 10C to return to the original position (FIG. 10A), and the feeding rollers 524 and 525 rotate again to feed the tape 521. At this time, the disc 549 (FIG. 7) rotates in the arrow direction K while at the same time the tape guide member 537 and the unit sheet-stack guides 538 and 538 rotate, as shown in FIG. 10C. The rotation is $2\times\frac{1}{4}$ turns, for example. Then, when the guide members 537, 538 and 538 are postured substantially vertically as shown in FIG. 10D, the rotation and the tape 521 feeding are stopped. As described above, one end of the tape 521 fed by the feeding rollers 524 and 525 is wound by about two turns, as shown in FIG. 10D and the leading end portion 521*a* of the tape is suspended in the space defined by the loop so as to divide the space into two sections. After the tape loop is thus previously formed, the loop waits the unit sheet-stack P1 fed by the arm 510. The bundling loop 546 is formed on the right side portion of the tape insertion preventive plate 543, as shown in FIG. 8.

Once the bundling loop 546 is formed, the dividing plate 508 (FIG. 8) swings about the fulcrum of the shaft 517 downwardly. At this time, the dividing plate is inserted into the center of the thickness of the unit sheet-stack P1 substantially vertically postured on the movable bottom plate 515 (FIG. 8), so that the unit sheet-stack P1 is divided into two sub-unit sections by the dividing plate 508. When the stack is divided, the pushing member 507 retracts by a distance corresponding to the thickness of the dividing plate 508 thereby to facilitate the insertion of the dividing plate 508 to the unit sheet-stack P1. The dividing plate 508 temporarily stops, being inserted within the unit sheet-stack P1. In this way, when the dividing plate 508 stops within the unit sheet-stack P1, the feeding arm 510 (FIG. 8) advances in the arrow direction H and feeds the unit sheet-stack P1 divided on the movable bottom plate 515, while holding it, along the guide wall 509 in the arrow direction H. At this time, the pushing member 507 retracts (moves to the right in FIG. 7), as shown in FIG. 9F to return to the original position to stop thereat. At this time, the rotatory drums 501 and 501 close the clamp member 506 to clamp the next unit sheet-stack and to rotate by 90° and repeats the above-mentioned operation. In this way, the divided unit sheet-stack P1 fed by the feeding arm 510 (FIG. 8) is guided by the unit sheet-stack guide members 538 and 538 and are stopped at the position where it is inserted into the bundling loop 546, as shown in FIGS. 8 and 10D. At this stage, the tape guide member 537 is inserted between the sub-unit sheet-stacks divided, as shown in FIG. 10D. At this time, the dividing plate 508 swings upwardly (FIG. 8) to retract from the unit sheet-stack P1 to return to the original position and stop thereat.

Figure 10E:
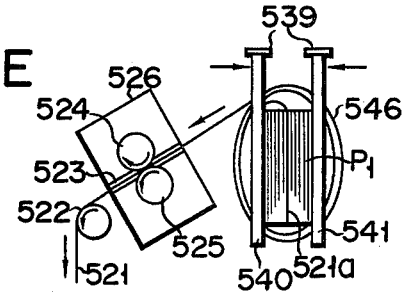
Figure 10F:
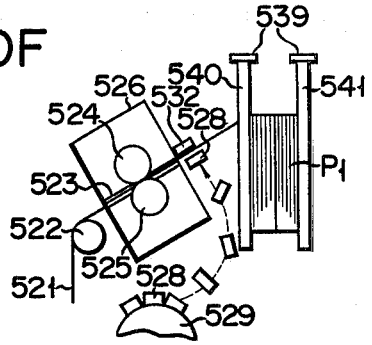

When the unit sheet-stack P1 is inserted at the leading end into the bundling loop 546, and the dividing plate 508 returns to the original position, the tape guide member 537 and the unit sheet-stack guide members 538 and 538 retracts (moves to the left in FIG. 8), together with the disc 549, and goes into the drive section 542 in FIG. 8. At this time, the tape pull-in preventive plate 543 (FIG. 8) prevents the bundling loop 546, as well as the guide members 537, 538 and 538, from being pulled in. The free end 521*a* of the tape suspended in the inner space of the bundling loop 546 is positioned between the first and second sub-unit sheet-stacks divided. When the respective guide members 537, 538 and 538 retard, the drive arms 539 and 539 perform the closing operation, so that the unit sheet-stack P1 is nipped by the clamp bars 540 and 540, and 541 and 541 to be clamped. Therefore, the leading end portion 521*a* of the tape is inserted into the unit sheet-stack P1, as shown in FIG. 10E. At this time, the feeding arm 510 (FIG. 8) retracts, or moves to the right to return to the original position and stop thereat. When the unit sheet-stack P1 is clamped by the clamp bars 540 and 540, and 541 and 541, the feeding rollers 524 and 525 rotates in the reverse direction to that in which the feeding rollers 524 and 525 feed the tape, so that the tape 521 is retracted to squeeze the bundling loop 546, as shown in FIGS. 10E and 10F. Upon the completion of the squeezing of the loop, the arm 527 (FIG. 7) rotates counterclockwise and the pasting pad 528 revolves and rotates, as shown in FIG. 10F, so that the tape 521 is pasted at the pad receiving member 532. Following the pasting of the tape, the pasting pad returns to the original position.

Figure 10G:
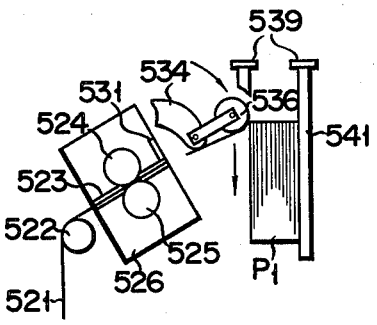
Figure 10H:
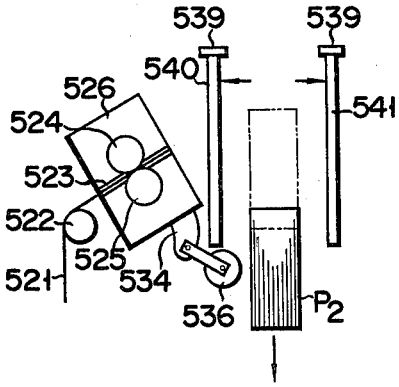
Figure 10I:
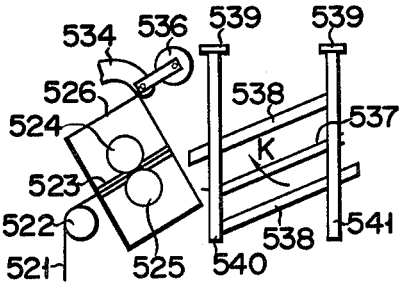

In this way, when the pasting work for the tape 521 is completed, the arm 534 rotates clockwise and the squeezing roller 536 moves, as shown in FIG. 10G, so that the roller 536 comes in contact with the corner of the unit sheet-stack to push the tape 521. At this time, the cutter 531 operates to cut the tape 521. Then, squeeze roller 536 rotates downwardly on the tape wound around the unit sheet-stack P1 with the rotation of the arm 534, while pressing the tape. Through this rotation of the squeeze roller, and end portion of the tape which is pasted and cut is fastened onto the tape wound around the unit sheet-stack P1 and forcibly presses the tape. In this way, the unit sheet-stack P2 bundled by the tape 521 is obtained. The unit sheet-stack in this state will be called a bundled unit sheet-stack P2. When the pasting and squeezing operations by the squeezing roller are completed, the movable bottom plate 515 (FIG. 7) opens, as indicated by a two-dot chain line and the arms 539 and 539 are also opened. Upon this, the clamp for the bundled unit sheet-stack by the clamp bars 540, 540, 541 and 541 is released and the bundled unit sheet-stack P2 falls naturally and is guided to the bundled unit sheet-stack classifying device 600 located under the bundling device. When the bundled unit sheet-stack P2 drops to the classifying device 500, the squeezing roller 536 returns to the original position, as shown in FIG. 10I, and the guide members 537, 538 and 538 which have been pulled in the drive portion 542 (FIG. 8) advances to return to the state shown in FIG. 8. Then, the disc 549 (FIG. 7) rotates again in the arrow direction K and the respective guide members 537, 538 and 538 also rotate, as shown in FIG. 10I and return to the original position and then prepare for the net bundling loop forming operation.

BUNDLED UNIT SHEET-STACK STAMPING DEVICE

Figure 11:
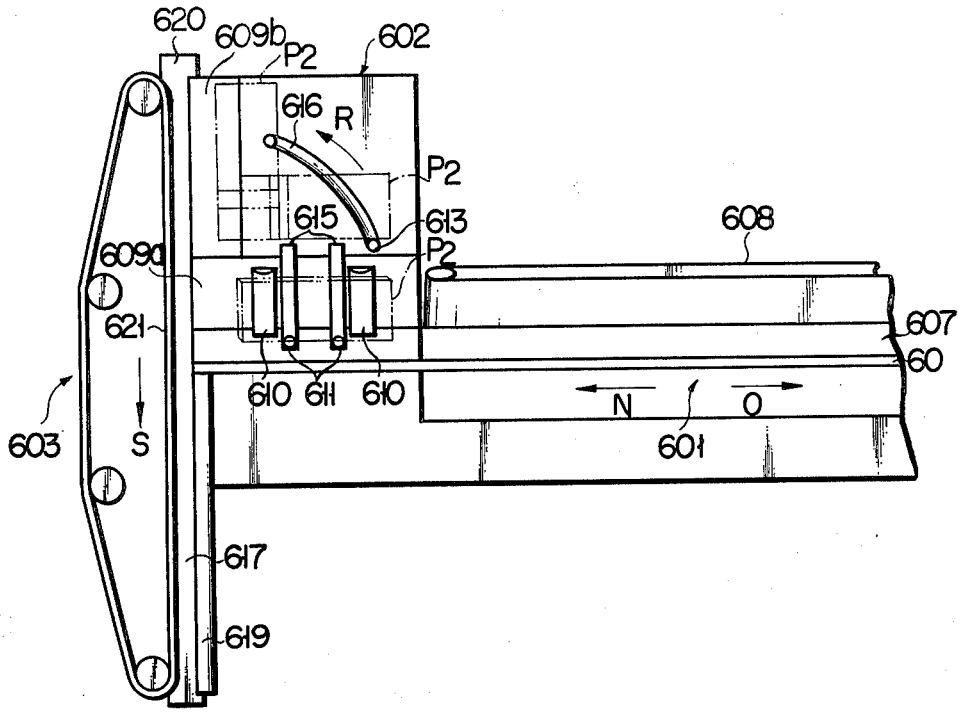
FIG. 11 is a plan view of a sorting device for sorting bundled sheet-stacks.
Figure 12A:
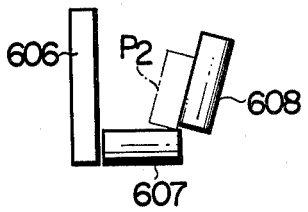
FIGS. 12A to 12B are side views of the details of the essential parts of the sorting device shown in FIG. 11.
Figure 12B:
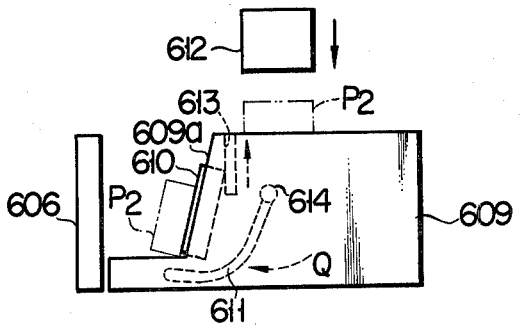

The bundled unit sheet-stack stamping device 600, as shown in FIG. 11, is comprised of a bundled unit sheet-stack take-out path 601, a stamping section 602 and a transfer path 603. The take-out path 601 receives the bundled unit sheet-stack P2 which naturally falls thereon from the unit sheet-stack bundling device 500, and transfers the bundled sheet-stack in the arrow direction N, i.e. to the left in FIG. 1, being postured substantially vertically (in fact, being slanted by approximately 15° with respect to the vertical line). As well illustrated in FIG. 12A, the take-out path 601 is comprised of a guide wall 606, a horizontal transfer belt 607, and a vertical transfer belt 608 slanted outwardly by approximately 15° . The stamping section 602, provided at the end portion of the take-out path 601, stamps a specific stamp on the tape (small strip) of the incoming bundled unit sheet-stack P2. As shown in FIG. 12B, the stamping section 602 is comprised of a stamping table 609, transfer rollers 610 and 610, left arms 611 and 611, a stamper 612 and a scrape-out bar 613. The stamping table 609, disposed facing the guide wall 606, has slanted surfaces **609*a* and 609*b* on the guide wall 606 side and the transfer path 603 side. Transfer rollers 610 and 610 receive the incoming bundled unit sheet-stack P2 and transfer it to a given position, and are disposed in parallel along the slanted surface 609*a* of the stamping table 609, substantially vertically. Lift arms 611 and 611, shaped like an arc, are swung in the arrow direction Q on the fulcrum of a shaft 614, if necessary. Those move along grooves 615 and 615 with the end portions projecting above the slanted surface 609*a*. The lift arms 611 and 611 are normally positioned within the stamping table 609. The stamper 612 is positioned above the stamping table 609 and descends onto the stamping table 609, if necessary. The scrape-out bar 613 scrapes out the bundled unit sheet-stack P2 on the stamping table 609 along the slanted surface 609*a* of the stamping table 609 onto the next transfer path 603 by rotating counterclockwise by about 90° on the fulcrum of the left end (in a state indicated by a two-dot chain line shown in FIG. 11). The scrape-out bar 613 extends to the end portion within an arc groove 616 formed on the upper surface of the stamping table 609, as required, and moves along the groove 616 in an arrow direction R. The transfer path 603 receives the bundled unit sheet-stack P2 scraped out from the stamping table 609 and transfers it to the transfer device 800 to be described later in an arrow direction S (normal to the take-out direction of the take-out path 601), with the bundled unit sheet-stack P2 being postured vertically. The transfer path 603 is comprised of a guide wall 619, a horizontal transfer belt 620, and a vertical transfer belt 621**.

The operation of the bundled unit sheet-stack stamping device 600 will be described hereinafter. At the instant the bundled unit sheet-stack P2 falls from the bundling device 500 onto the transfer path 601, the take-out path 601 temporarily moves in an arrow direction O, and them in an arrow direction N. This is made for assisting the natural falling of the bundled unit sheet-stack P2. To be more specific, when clamp bars 540, 540, 541 and 541 in the bundling device 500, clamping the bundled unit sheet-stack P2, are released, the bundled end portion (the left side end portion in FIG. 8) of the bundled unit sheet-stack P2 comes in contact with the clamp bars 540, 540, 541 and 541 or the respective guide members 537, 538 and 538, so that the bundled unit sheet-stack P2 falls in a state that it is somewhat slanted with the end of the bundled stack being up but the other end being down. When the transfer path 601 suddenly operates in the arrow direction N, the bundled unit sheet-stack P2 becomes in a vertical state with the shorter side (width) being horizontal, with the result that the transfer path 601 instantaneously operates in the arrow direction O, thereby to prevent it.

Therefore, the bundled unit sheet-stack P2 dropped on the take-out path 601 is taken out in the substantial vertical state, of which the bundled end portion is headed and the longitudinal side is directed horizontally. When the bundled unit sheet-stack P2 reaches the stamping section, the sheet-stack P2 is transferred to the transfer rollers 610 and 610 and carried to a given position as indicated by a two-dot chain line in FIG. 11, and is stopped thereat. When the bundled sheet-stack P2 stops at the given position, the lift arms 611 and 611 swing in the arrow direction Q. At this time, the left arms 611 and 611 protrude the leading ends from the lower end of the slanted surface **609*a* beyond the upper end and arms 611 and 611 continue to swing along the grooves 615 and 615. As a result, the bundled unit sheet-stack P2 is lifted along the slanted surface 609*a* in a state that it is placed on the leading ends of the lift arms 611 and 611 and is transferred to the stamping table 609 as indicated by the two-dot chain line shown in FIG. 11 and FIG. 12B. When, the bundled unit sheet-stack P2 is placed on the stamping table 609, the stamper 612 falls to press a given stamp on the tape of the bundled sheet-stack. Then, it rises to return to the original position. Upon the completion of the stamping operation, the scrape-out bar 613** projects above the stamping table 609, and moves along the groove 616 in the arrow direction R. At this time, the scrape-out bar 613 projects to this side of the right end (the end opposite to the bundling portion) of the bundled unit sheet-stack P2 indicated by a two-dot chain line in FIG. 11. Accordingly, the bundled unit sheet-stack P2 on the stamping table 609 is rotated counterclockwise by about 90° on the fulcrum of the left end (FIG. 11), with the movement of the scrape-out bar 613. The bundled unit sheet-stack P2 is in a state indicated by the onedot chain line in FIG. 11. At this time, the bundled unit sheet-stack P2 protrudes at the left end (the left end in the state indicated by the one-dot chain line FIG. 11) above the slanting surface 609*b*. As a result, the bundled unit sheet-stack P2, upon the pushing action by the movement of the scrape-out bar 613, falls to the start end of the transfer path 603 along the slanting surface 609*b*. Accordingly, the transfer path 603 transfers to the transfer device 800 in processing section 20 to be described later the bundled unit sheet-stack P2 dropped from the stamping table 609 in the arrow direction S, being postured vertically with the longitudinal side thereof directed horizontally.

The display panel 700 shown in FIG. 1, designed for graphically display operating conditions of the sheetlike material processing apparatus, is provided with a group of display lamps which are lit when an abnormal operation such as a jam takes place, an abnormal code display for displaying an abnormal in the form of a numerical code, a group of sheet-kind display lamps for displaying a kind of the sheets set, and a display for displaying the total number of sheets processed. The display panel 700 further includes a power source input switch for turning on the power source of the sheet-like material processing apparatus, a detection check switch for checking the detection operation of the inspecting device 200, an arranging switch for merely arranging the sheets, not sorting the sheets into the normal and soiled sheets, a detection stop switch for stopping the detecting function of the inspecting device 200, and an open-operable switch used when the apparatus is operated while a plurality of transparent doors (not shown) provided on the front panel (the front panel confronting the respective mechanical sections in FIG. 1) of the apparatus are left open. Those switches are of the glittering type. Provided on the operating board 701 are a processing start switch and a continuous take-out switch.

Figure 13:
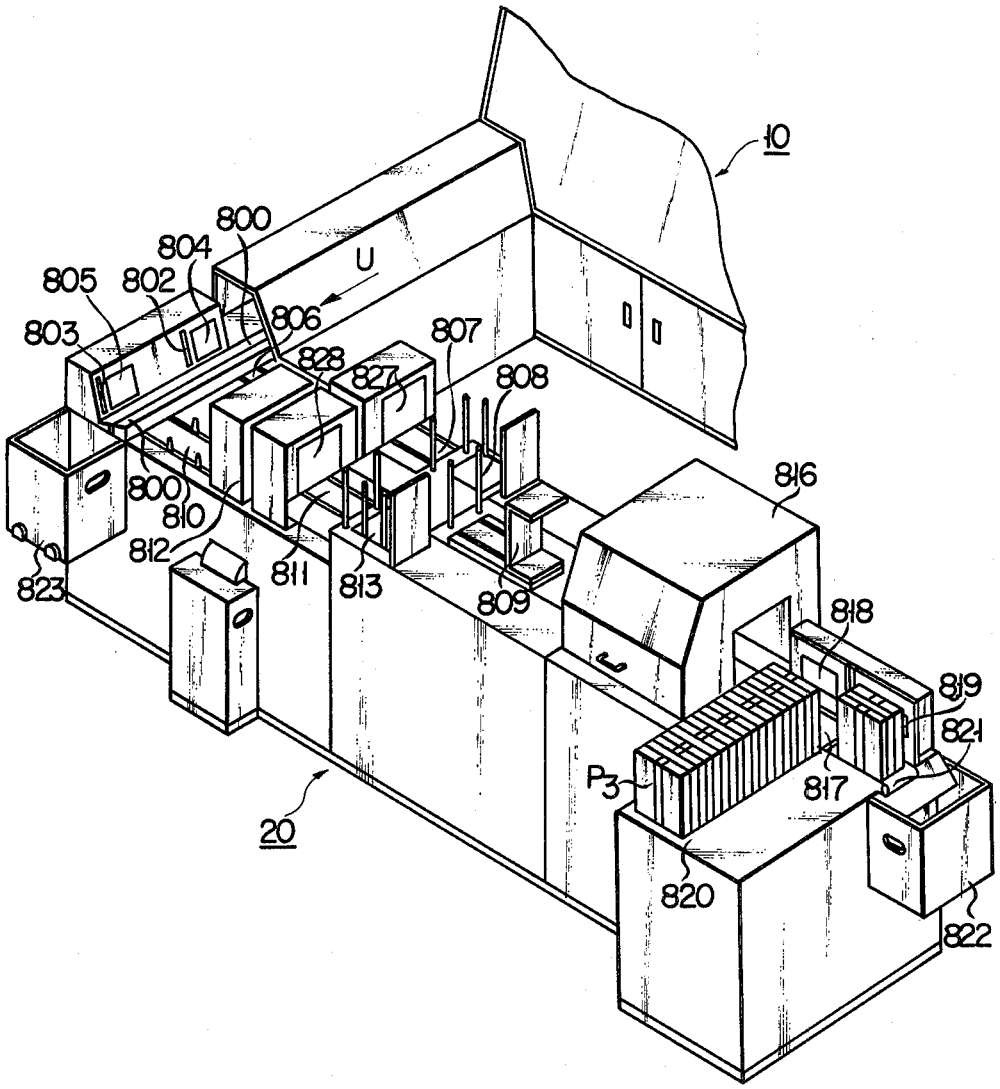
FIG. 13 is a perspective view of the latter half of the sheet-like material processing apparatus according to the embodiment of the invention.

FIGS. 13 and 14 are an external view and a schematic view of a post processing section 20 of the sheet-like material processing apparatus provided at the poststage in the apparatus. The poststage processing unit 20 sorts the bundled unit-sheets transferred from the preceding processing device 10 into the normal sheet bundles and the soiled sheet bundles, invalidates the soiled sheet bundles, collects separately the respective bundles, and further bundles the bundled unit-sheet stacks every 10 sheet-stacks. The construction of the poststage processing device 20 will be described hereinafter.

In FIGS. 13 and 14, the transfer device 800 receives the bundled unit sheet-stack P2 transferred from the bundled unit sheet-stack stamping device 600 in the prestage processing device 10, holds and transfers it in a substantially vertical state in an arrowed U direction, and guides it to the tape color detector 801, a normal gate 802, and a soiled sheet gate 803. The tape color sensor 801, provided in the mid portion of the transfer device 800, senses optically the color of the bundled tape of the incoming bundled unit sheet-stack P2. The normal sheet gate 802 is provided on the mid portion of the transfer device 800, operates when it receives the green (normal sheet) sensing signal from the sensor 801, and stops the incoming corresponding bundled unit sheet-stack P2 (normal sheet) to hold its stoppage state until the normal sheet pushing member 804 operates. When the sensor 801 produces a yellow (soiled sheet) sensing signal, the normal gate 802 does not operate and the transfer device 800 transfers the bundled unit sheet-stack P2 to the soiled sheet pushing member 805. In this way, the normal sheet pushing member 804 operates when the normal sheet gate 802 stops the bundled unit sheet-stack P2, and pushes the bundled unit sheet-stack P2, or the normal sheet-stack, from the transfer device 800 to lay it down. At this time, when the next normal sheet-stack reaches, it is superposed on the preceding normal sheet-stack by means of the normal sheet pushing member 804. Then, the superposed ones are transferred along the normal sheet-stack transfer path 806 to a normal sheet-stack collecting device 807 (to be described later referring to FIG. 15) where those of 10 are collected. When those stacks are collected to reach 10 stacks, the normal sheet-stacks are pushed into a normal sheet-stack waiting section 808. At this time, if there is no bundle in a bundle supply section 809, the normal sheet-stack waiting section 808 supplies 10 of the normal sheet-stacks bundled into the section 809.

The soiled sheet gate 803, provided at the end portion of the transfer device 800, responds to a yellow (soiled sheet) sensing signal derived from the sensor 801 to operate. The soiled sheet gate 803, when operated, stops the corresponding bundled unit sheet-stack P2 (of the normal sheet) transferred and holds its stoppage until the soiled sheet pushing member 805 operates. The soiled sheet pushing member 805 pushes out the bundled unit sheet-stack P2 from the transfer device 800 and lays it down. At this time, when the next soiled sheet-stack reaches, the soiled sheet-stack is superposed on the preceding one by the pushing member 805, and then those superposed ones are transferred to the soiled sheet-stack collecting device (to be described later referring to FIG. 15) along the soiled sheet-stack transfer path 810. An invalidation device 812 is provided on the soiled sheet-stack transfer path 810 located preceding to the soiled sheet-stack collecting device 811. The invalidation device 812 (to be described later referring to FIG. 16) punches the soiled sheet-stack at the portion where a bill number or a share number are printed for invalidating it. The invalidated soiled sheet-stack is transferred to the bundled, soiled sheet-stack collecting device 311 along the soiled sheet-stack transfer path where those are collected by 10. When the soiled sheet-stack collecting device 811 collects 10 bundles of the soiled sheet-stacks, the 10 bundles of the soiled sheet-stacks are pushed into a soiled sheet-stack waiting section 813.

The bundle supply section 809 receives the 10 bundles of the sheet-stacks from the normal sheet-stack waiting section 803 or the soiled sheet-stack waiting section 813, and transfers it to a bundling section 814 for bundling the 10 stacks. In connection with the transfer order of the sheet-stacks from the normal sheet-stack waiting section 808 and the soiled sheet-stack waiting section 813 to the bundle supply section 809, the 10 sheet-stacks first pushed out from the normal or soiled sheet-stack collecting device 807 or 811 to the corresponding waiting section 808 or 811 is given top priority of the transfer order. Specifically, when the bundle supply section 809 has 10 sheet-stacks, the succeeding sheet-stacks wait in the normal sheet-stack waiting section 808 or the soiled sheet-stack waiting section 813 till the 10 sheet-stacks staying in the bundle supply section 809 are supplied to the empty bundling section 814. In the bundling section 814, the 10 sheet-stacks transferred from the bundle supply section 809 are bundled by a paper tape winding the stacks in a crossing manner. The bundle of the 10 sheet-stacks, or the unit sheet-stack P3, is transferred along a bundle transfer path 815 to a bundle sensing device 817 to be described later. The bundle supply section 809, the bundling section 814 and the bundle transfer path 815 constitute a bundling device 816 for bundling the 10 sheet-stacks, which will subsequently be described referring to FIGS. 17 and 18. The bundle sensing device 817 to be described later referring to FIG. 20 or 21 checks whether or not the incoming piled sheet-stacks, or the unit sheet-stack P3, includes 10 stacks by measuring the weight or the thickness of the unit sheet-stack P3. Generally, the sheet-like material such as securities or shares have a fixed size and thickness. Therefore, it is possible to discriminate the number of the sheet-stacks transferred by measuring the weight or the thickness thereof. After checking the unit sheet-stack P3 which includes 10 sheet-stacks, the bundle sensing device 817 pushes the unit sheet-stack P3, by means of a bundle pushing member 818 or 819, onto a bundle collecting table 820. When the bundle sensing device 817 judges that the unit sheet-stack P3 is less than 10, the unit sheet-stack P3 is transferred by the bundle transfer path 821 and is led to a bundle reject collecting section 822.

In addition to the color of the tape, the tape color sensor 801 senses the length and width of the bundle of the sheet-stacks in order to check whether or not any sheets protrude from the bundle. When such an irregular bundle is detected, each of the pushing members 804 and 805 does not operate, so that the corresponding bundle is transferred by the transfer device 800 to be led to the bundle reject collecting section 823.

FIG. 15 is useful in explaining in detail the operation of the normal bundled sheet-stack collecting device 807 for collecting a couple of the superposed, two normal bundled unit sheet-stacks P4 (soiled bundled unit sheet-stack P5) transferred along the normal sheet-stack transfer path 806 (soiled sheet-stack transfer path 810) up to 10 stacks. As shown in FIG. 15A, the normal bundled unit sheet-stack P4 (soiled bundled unit sheet-stack P5) transferred along the normal sheet-stack transfer path 806 (soiled sheet-stack transfer path 810) reaches the pushing member 824. At this time, it is stopped by a stopper 825. A detector (not shown) such as a microswitch, which is provided near the pushing member 824, detects that the normal bundled unit sheet-stack P4 (soiled bundled unit sheet-stack P5) is placed on the pushing member 824. At this time, a detecting signal is produced from the detector and drives the pushing member 824. The pushing member 824 driven rises to push upwardly the normal bundled unit sheet-stack P4 (soiled bundled unit sheet-stack P5), as shown in FIG. 15B. The normal bundled unit sheet-stack P4 (soiled bundled unit sheet-stack P5) is further pushed up to a position free from the interference with the gate 826, as shown in FIG. 15C. At this point, the gate 826 self-returns to a closed state. Then, the pushing member 824 falls to return to the original position, as shown in FIG. 15D. The structure is so designed that under this condition, the pushing member 824 does not interfere with the gate 826 each other. Accordingly, the pushing member 824 passes through the gate 826 to descend. When the pushing member 824 descends in this way, the normal bundled unit sheet-stack P4 (soiled bundled unit sheet-stack P5) pushed upwardly is left on the gate 826. Accordingly, when the pushing member 824 returns to the original position, a counter (not shown) is subjected to "+1" operation. The above-mentioned operation is repeated every time the normal bundled unit sheet-stack P4 (soiled bundled unit sheet-stack P5) reaches there. As seen from FIGS. 15E to 15H illustrating an operation state made when the succeeding normal bundled unit sheet-stack P4 (soiled bundled unit sheet-stack P5) reaches, the operation illustrated in FIGS. 15A to 15D is repeated.

Through the repetition of the operations, the counter has "5". At this time, the pushing member 827 (828) shown in FIGS. 13 and 14 operates to push the 10 normal bundled unit sheet-stack P4 (soiled bundled unit sheet-stack P5) collected on the gate 826 toward the normal sheet-stack waiting section 808 (soiled sheet-stack waiting section 813).

Figure 16C:
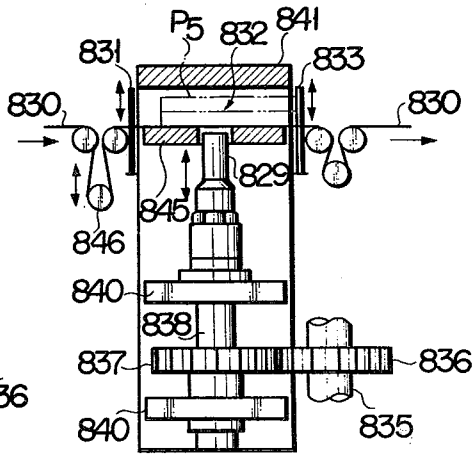
Figure 16B:
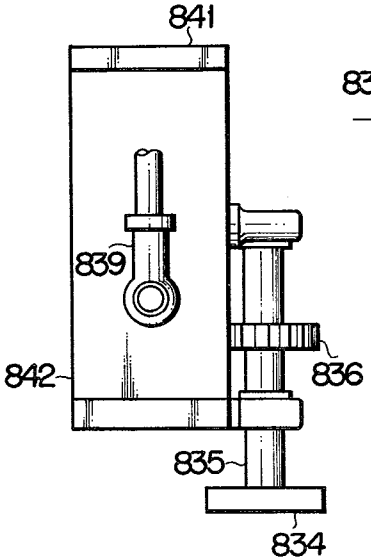
Figure 16A:
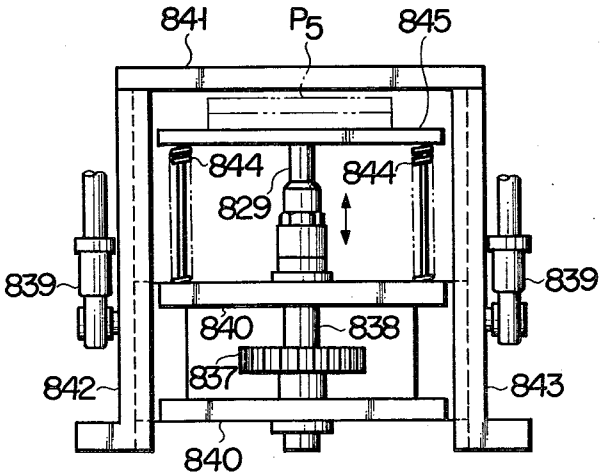

FIG. 16 shows a detailed structure of the invalidation apparatus as mentioned above. A punch head 829 punches a hole at a given location of the superposed two transferred soiled bundled unit sheet-stacks P5. A transfer belt 830 of the soiled sheet-stack bundle transfer path 810 is installed apart from the punching head 829. When the soiled bundled unit sheet-stack P5 arrives by the transfer belt 830, a pin 831 at the entrance descends by virtue of a vertical drive mechanism. As a result, the soiled bundled unit sheet-stack P5 enters the invalidation section 832 to be in contact with pin 833 at exit side. When the soiled bundled unit sheet-stack P5 stops at the invalidating section 832, the transfer belt 830 stops and the pin 831 rises to inhibit the entrance of the succeeding soiled bundled unit sheet-stack P5. Under this condition, a drive motor operates, so that a pulley 834 coupled therewith through a belt (not shown) rotates gear 836 coupled therewith through a shaft 835. The gear 837 is rotated by gear 836 intermeshed therewith which in turn rotates the punch head 829 coupled therewith through a shaft 838. When the punch head 829 rotates, a crank 839 is driven by a drive mechanism (not shown), so that the punch head mounting member 840 is guided by grooves (not shown) formed in right and left side walls 842 and 843 fixed to the upper holding plate 814, and slides vertically.

A lower holding plate 845 is provided above the mounting member 840, through coil springs 844 and 844. When the mounting member 840 rises through the operation of the crank 839, the soiled bundled unit sheet-stack P5 are compressed between the lower and upper holding plates 845 and 841. At the same time, the punch head 829 rises, while rotating, to punch a hole, that is, to effect the invalidation. Also at this time, with the rise of the lower holding plate 845, the transfer belt 830 rises within the invalidation section 832, too. A roller 846 at the entrance side moves upwardly so as to compensate for the shortage caused by the rise of the transfer belt 830. Thus, through the operation of the crank 839, the mounting member 840, the punch head 839, and the lower holding plate 845, which have risen, descend to return to their original positions after the completion of the punch. Upon this, the transfer belt operates again while at the same time the pin 833 descends, so that the invalidated soiled bundled unit sheet-stack P5 is sent to the soiled sheet-stack bundle collecting device 811. When the invalidated soiled bundled unit sheet-stack P5 is carried outwardly from the invalidating section 832, the pin 833 rises again to stop the next soiled bundled unit sheet-stack P5 transferred by the transfer belt 830. The punching operation as mentioned above is repeated.

Figure 17:
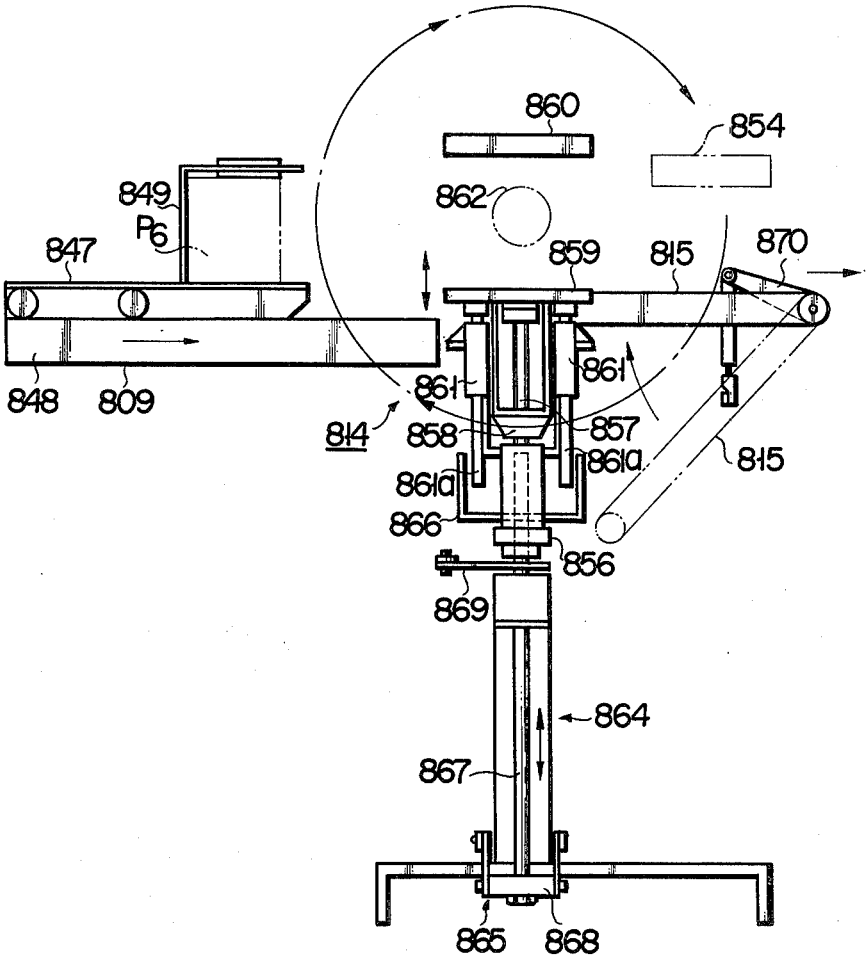
FIGS. 17 and 18 are side view and plan view of the bundling device respectively.
Figure 18:
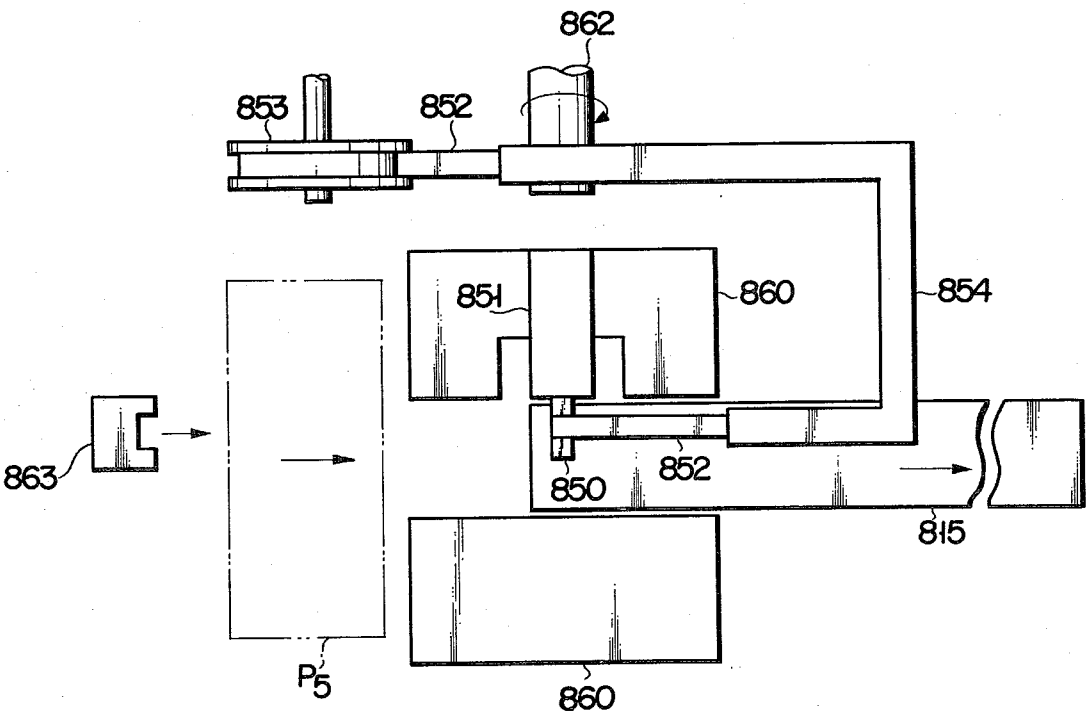

FIGS. 17 through 19 illustrate a detail structure of the bundling device 816. As shown, the bundle supply section 809 is comprised of a bundle carrier 847, a rail 848 and a bundle receptacle 849. For supplying the bundled unit sheet-stack P6 to the bundling section 814, the carrier 847 moves on the bundle supply rail 848 in an arrowed direction as shown to send the receptacle 849 having 10 normal bundled unit sheet-stack or the soiled bundled unit sheet-stack (referred to as a bundled unit sheet-stack P6) transferred from the normal sheet-stack waiting section 808 or the soiled sheet-stack waiting section 813, to the bundling section 814. See FIG. 19A.

Figure 19B:
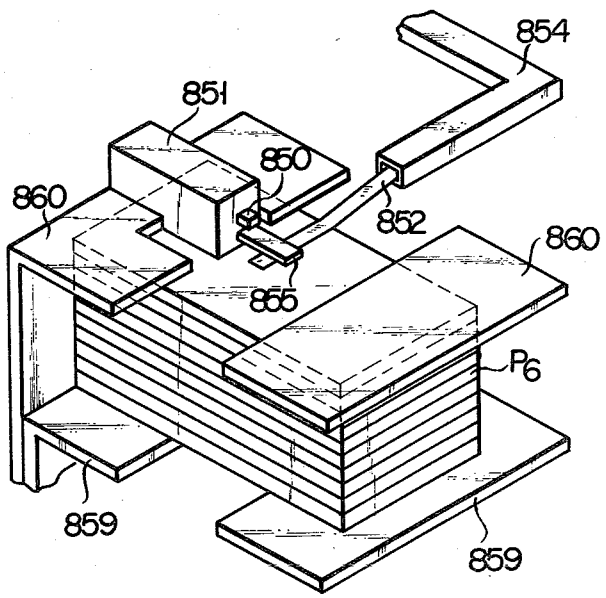
FIGS. 19A to 19F are series of perspective views useful in explaining the construction and operation of the bundling device.
Figure 19A:
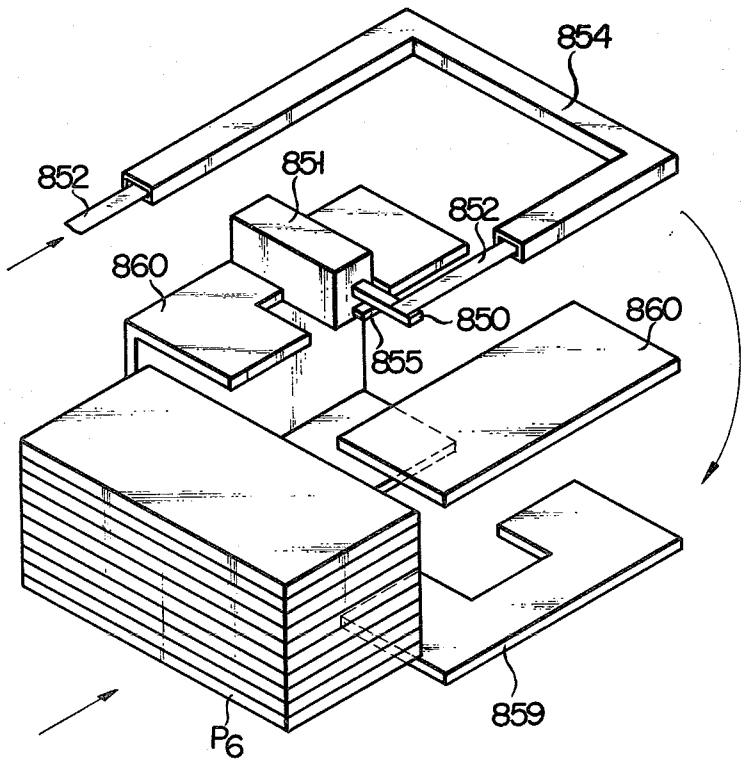

The construction of the bundling section 814 follows. Upon the supply of the bundled unit sheet-stack P6, a fixed cutter 850 pulls it into the drive mechanism 851 and then a paper tape 852 placed on the fixed cutter 850 falls at the leading end onto the bundled unit sheet-stack P6 (FIG. 19B). Normally, the fixed cutter 850 is projected with the leading end of the tape 852 being placed thereon. See FIG. 19A. The tape 852 is led into a tape guide arm 854 substantially U-shaped by a tape feed mechanism (not shown) and is supplied first at the leading end of the arm 854 thereof. In this way, the leading end of the tape 854 falls on the bundled unit sheet-stack P6, so that a tape holding member 855 projects from the drive mechanism 851 to position at the location corresponding to the leading end of the tape 852 of the bundled unit sheet-stack P6. See FIG. 19B. That is, the holding member 855 is located under the fixed cutter 850 and is normally within the drive mechanism 851. The drive mechanism 851 is fixed on an upper chuck 860 to be described later. When the holding member 855 projects, a gear 856 is rotated by a gear mechanism (not shown). The gear 856 also rotates a shaft 857 coupled with the gear 856. A pushing table 858 is screwed around the screwed end portion of the shaft 857. Accordingly, the pushing member 857 rises with the rotation of the shaft 857 to push up the lower chuck 859. Upon this, the bundled unit sheet-stack P6 is compressed between an upper chuck 860 fixed to the upper portion of the lower chuck 860 and the lower chuck 859 while at the same time the leading end of the tape 852 is pressed against the bundled unit sheet-stack P6 by means of the holding member 855. See FIG. 19B. A vertical sliding mechanism 861 is provided to vertically and rectilinearly move the lower chuck 859 without being rotated by the rotatory force of the pushing member 858. The mechanism is composed of a shaft **861*a* fixed to the lower surface of the lower chuck 859 and a linear bearing (not shown) for supporting the shaft 861*a*** axially.

When the bundled unit sheet-stack P6 is compressed between the lower chuck 859 and the upper chuck 860, a drive shaft 862 is rotated by a drive mechanism (not shown) to rotate thereabout several times (e.g. two times) clockwise the arm 854 connected at one end to the shaft 862. At this time, since the leading end of the tape 852 is held on the bundled unit sheet-stack P6, the tape 852 is pulled out of and wound around the bundled unit sheet-stack P6 in the width direction of the bundle several times (e.g. two times) and is firmly tightened. See FIG. 19C. At this time, with the rotation of the arm 854, the tape reel 853 also rotates with the arm 854. In this way, when the tape winding is completed, a pasting mechanism (not shown) starts to operate to past the tape **852*a* wound around the bundled unit sheet-stack P6. Following the pasting operation, the arm 854 operates again to rotate one turn and to stop. At this time, the fixed cutter projects again above the bundled unit sheet-stack P6 while the holding member 855 retreats again, so that the tape 852 is obliquely stretched between the angle of the bundled unit sheet-stack P6 and the fixed cutter 850. See FIG. 19C. Then, the sliding cutter 863 slides along a guide rail (not shown) in an arrow direction by a sliding mechanism (not shown), so that the sliding cutter 863 in cooperation with the fixed cutter 850 cuts the tape 852 at the obliquely stretched portion. At this time, a resilient push tongue provided on the lower surface of the sliding cutter 863, with the sliding of the cutter 863, slides onto the tape 852*a* of the bundled unit sheet-stack P6 to move along the pasted portion of the tape pressing against there. The pressing movement along the pasted portion ensures the pasting of the tape end cut. See FIG. 19C**.

When the pasting and the cutting of the tape 852 are completed, the gear 856 is rotated again to descend the lower chuck 859. When the lower chuck 859 descends, a 90° inverse rotation mechanism 864 operates to rotate the bundled unit sheet-stack P6 by 90°.

Figure 19D:
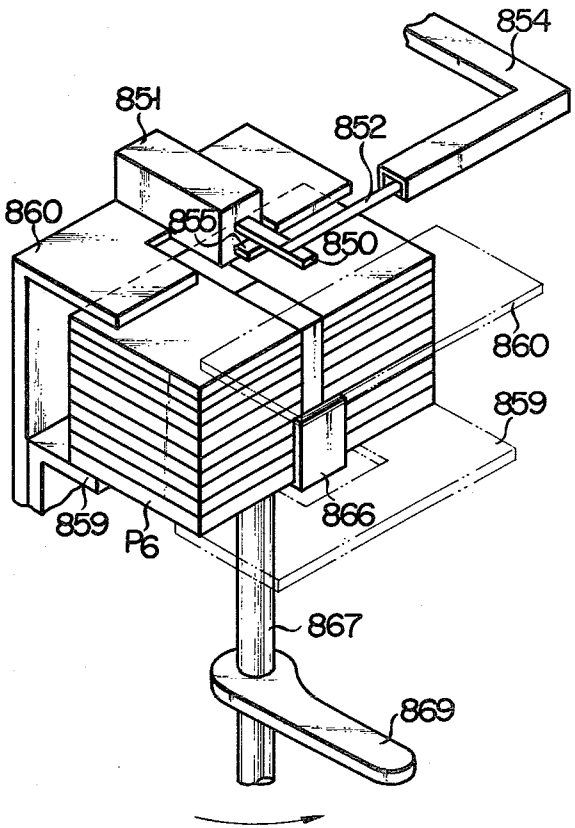
Figure 19C:
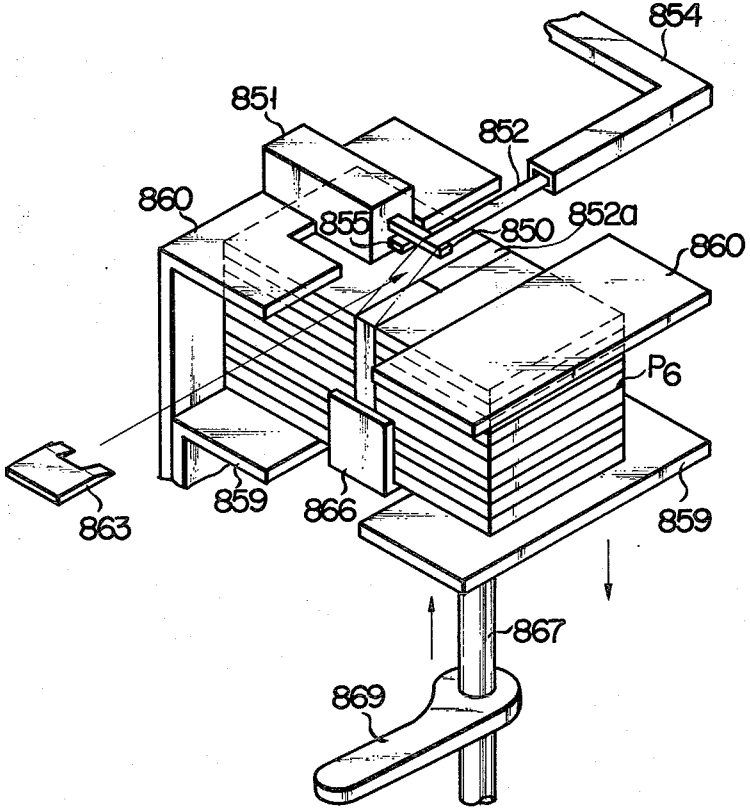
Figure 19E:
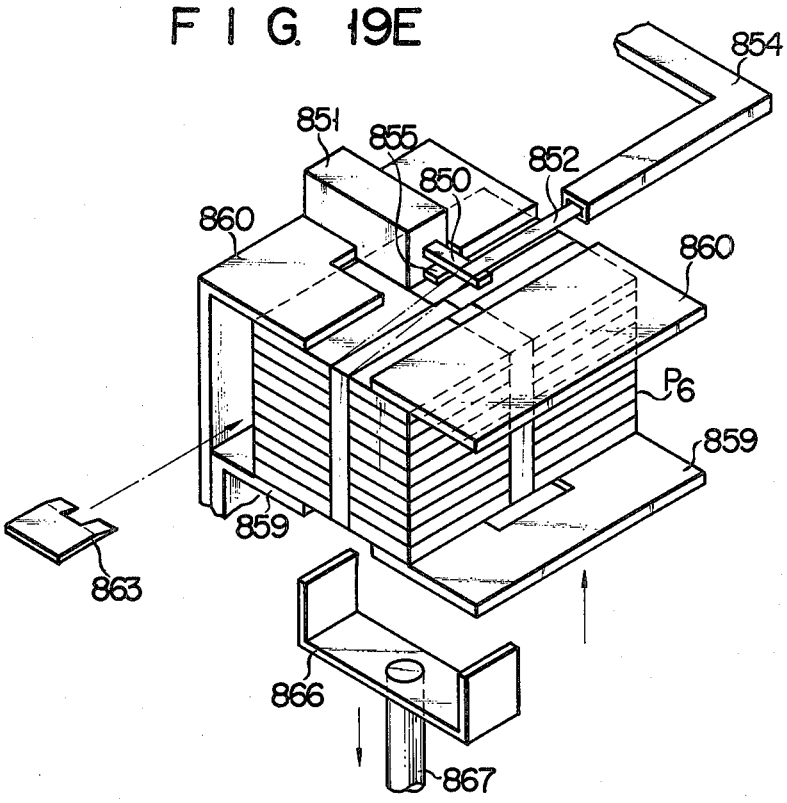
Figure 19F:
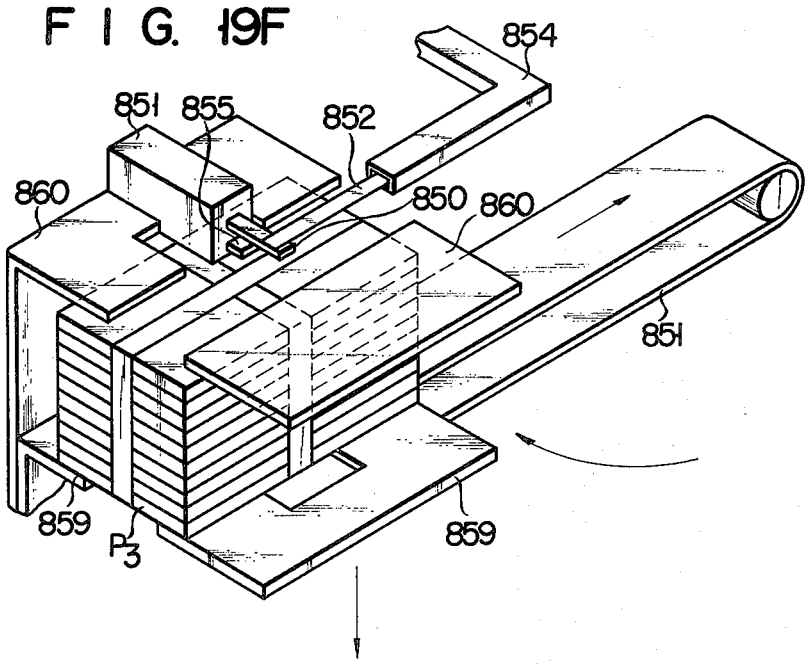

When a vertical drive mechanism 865 operates, a substantially U-shaped holding member 866 is risen to hold the bundled unit sheet-stack P6 on the lower chuck 859 (FIG. 19C). The vertical mechanism 865 is comprised of a shaft 867 fixed at the leading end to the holding member 866 and a slide mechanism 868 for vertically sliding the shaft 867. The holding member 866 is positioned at the lower portion corresponding to the substantially central portion of the lower chuck 859 and holds the tape wound portion of the bundled unit sheet-stack P6 on the lower chuck 859. Further, when the arm 854 is rotated, the holding member 866 does not interfere with the arm 854. In this way, when the holding member 866 holds the bundled unit sheet-stack P6, an inverting arm 869 is rotated counterclockwise by a cam mechanism (not shown), the holding member 869 is rotated by 90° through the shaft 867 (FIG. 19D). The inverting arm 869 has an engaging piece (not shown) projecting into a groove (not shown) axially formed on the peripheral surface of the shaft 867, so that the inverting arm is vertically slidable but is not rotated with respect to the shaft 867. When the sheet bundle is rotated by 90°, the vertical drive mechanism 865 operates again, so that the holding member 866 descends (FIG. 19E). When the holding member 866 descends, the inverting arm 869 rotates clockwise, so that the holding member 866 returns to its initial state. When the holding member 866 returns to the initial state, the fixed cutter 850 retracts again and the leading end of the tape 852 falls on the bundled unit sheet-stack P6 rotated by 90°. Subsequently, a similar operation to the tape winding operation in the width direction of the bundled unit sheet-stack P6, as mentioned above, is repeated. Through this operation, the bundled unit sheet-stack P6 is wound therearound several times in the length direction of the bundled unit sheet-stack P6. After this, the tape 852 is pasted and cut. At this point, the tightly bundling of the bundled unit sheet-stack P6 in the crossing manner is completed to form the bundled unit sheet-stack P3 (FIG. 19E). After the tightly bundling of the bundled unit sheet-stack, the lower chuck 859 descends again. When the lower chuck 859 descends, a bundle transfer path 815 positioned at the location indicated by a two-dot chain line in FIG. 17 is swung on a fulcrum of the right end thereof by the vertical drive mechanism 870, so that the left end portion is inserted between the lower chucks 859 and 859 in the bundling section 814 (FIG. 19F). Through the transfer operation of the bundle transfer path 815, the bundle tied in the crossing manner, that is, the bundled unit sheet-stack P3, is transferred out of the bundling section 814.

Figure 20:
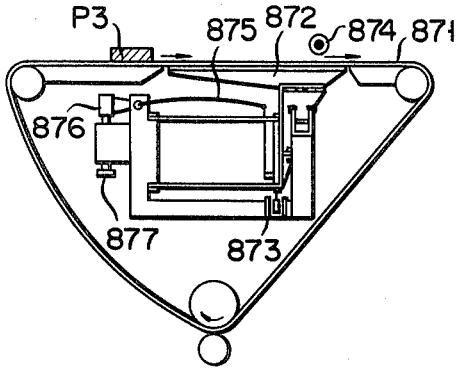
FIG. 20 is a side view of an example of a bundle detecting device.
Figure 21:
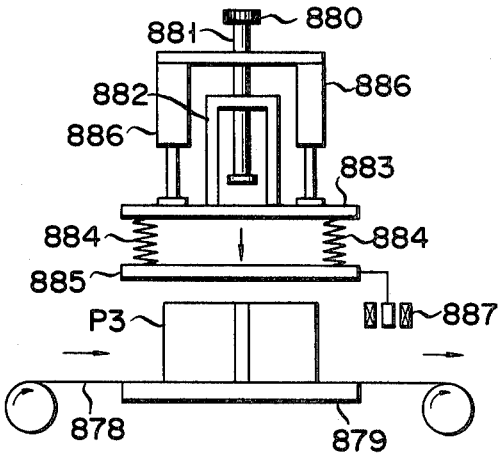
FIGS. 21 and 22 are side view and block diagram of another example of the bundle detecting device.
Figure 22:
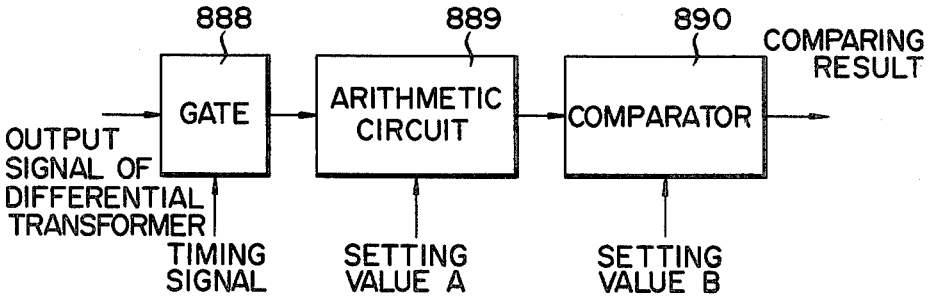

FIGS. 20 to 22 are detailed illustrations of the bundle sensing device 817. A mechanism shown in FIG. 20 detects whether the bundled unit sheet-stacks are 10 or not by measuring the weight of the bundled unit sheet-stacks, and is an application of the well known weight measuring device. The bundled unit sheet-stack P3 transferred along the bundle transfer path 815 of the tightly bundling device 816 is transferred to a weighing belt 871 which carries the bundled unit sheet-stack P3 to a weighing table 872. Upon receiving the bundled unit sheet-stack P3, the weighing table 872 descends with the weight of the bundled unit sheet-stack P3. An amount of the descending, i.e. weight, is measured by a differential transformer 873. Responding to a detecting signal produced by a position detector 874 when the bundled unit sheet-stack P3 reaches the position of the position detector 874, the differential transformer 873 transfers a corresponding output signal to a judging circuit (not shown), the judging circuit compares the output signal from the differential transformer 873 with light and heavy limit values, which are previously set, and produces the result of the comparison in the form of an electrical signal. A preloading spring 875 may be adjustable in its strength by a measure reference value setting dial 877 through a warm gear 876. The strength of the spring 875 is adjusted to the weight of a reference sheet bundle by means of the dial 877. When the adjusting result of the judging circuit is within the light and heavy limits, the bundled unit sheet-stack P3 weight-measured is pushed onto the bundle collecting portion 820 by means of the bundle pushing member 818 or 819. When the judging result is out of the range between the limit values, the bundle pushing member 818 and 819 do not operate. In this case, the bundled unit sheet-stack P3 is guided to a bundle reject collecting section 822 by the bundle transfer path 821.

FIGS. 21 and 22 illustrate an apparatus for detecting whether the bundled unit sheet-stacks are 10 or not by measuring the thickness of the bundled unit sheet-stacks. The bundled unit sheet-stack P3, transferred along the bundle transfer path 815 of the tightly bundling device 816, is transferred to the transfer belt 878 which in turn transfers the bundled unit sheet-stack P3 to the lower compression plate 879 and stop there. Then, a gear mechanism (not shown) rotates a gear 880 which rotates a shaft 881 coupled therewith. The end portion of the shaft 881 is notched for screw. The screw-notched portion is coupled, in screwing manner, with a substantially U-shaped pushing table to which the drive plate 883 is fixed. When the shaft rotates, the pushing table 882 descends to push the drive plate 883 downwardly. The lower surface of the drive plate 883 is coupled with the upper compression plate 885 with interposition of the coil spring 884 therebetween. Between the upper and lower compression plates 885 and 879, the bundled unit sheet-stack P3 is compressed. The spring 884 has an compression amount to such an extent to ensure that the upper compression plate 885 descends to a position corresponding to the thickness of the bundled unit sheet-stack P3, regardless of the fixed position of the drive plate 884. A vertical slide mechanism 886, comprising a shaft and a linear bearing (not shown) axially supporting the shaft, is provided to rectilinearly descend without being rotated by the rotational force of the shaft 881. An amount (thickness) of the descending of the upper compression plate 885 is measured by a differential transformer 887. The output signal from the differential transformer 887 is applied to a gate circuit 888, together with a timing signal produced when the rotation in the direction to descend the drive plate 883 of the gear 830 is terminated. Accordingly, the output signal from the differential transformer 887 is supplied to an arithmetic logic circuit 889 through a gate circuit when the timing signal is outputted. In the arithmetic circuit, a difference of it from a set value A is computed. A comparator circuit 890 compares the difference computed with a set value B and produces the result of it. When the output signal from the differential transformer 887 is produced from the gate circuit 888, the gear rotates again, so that the upper compression plate 885, together with the drive plate 883, rises to return to its initial state. The belt 878 operates again, so that the bundled unit sheet-stack P3 measured is transferred and handed to the bundle transfer path 821.

Figure 23:
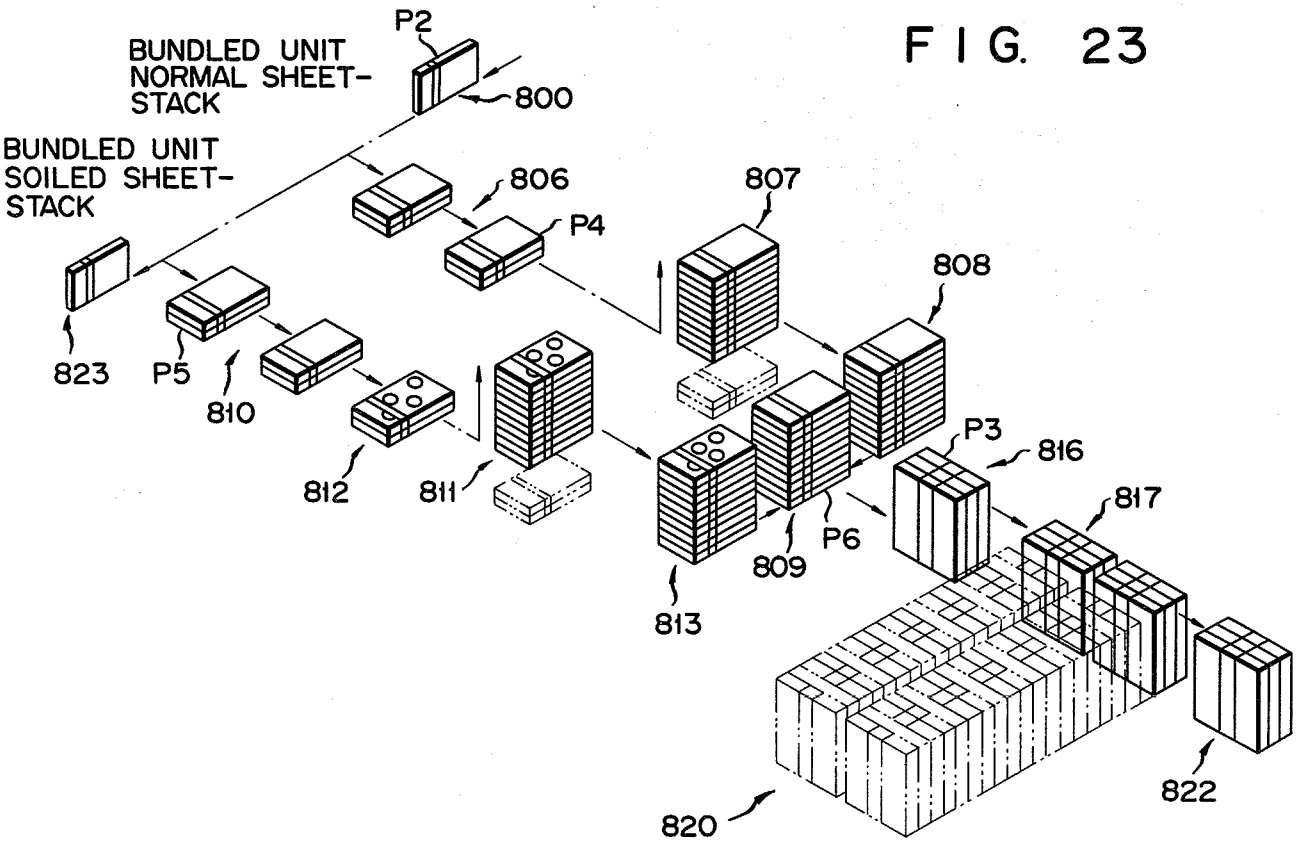
FIG. 23 is a schematic diagram for illustrating flows of the unit sheet-stack and bundles of the unit sheet-stacks in the latter half of the processing apparatus shown in FIG. 13.

FIG. 23 shows a process flow of the sheet-stack and sheet bundle at the respective portions of the post-processing section 20.

Figure 24:
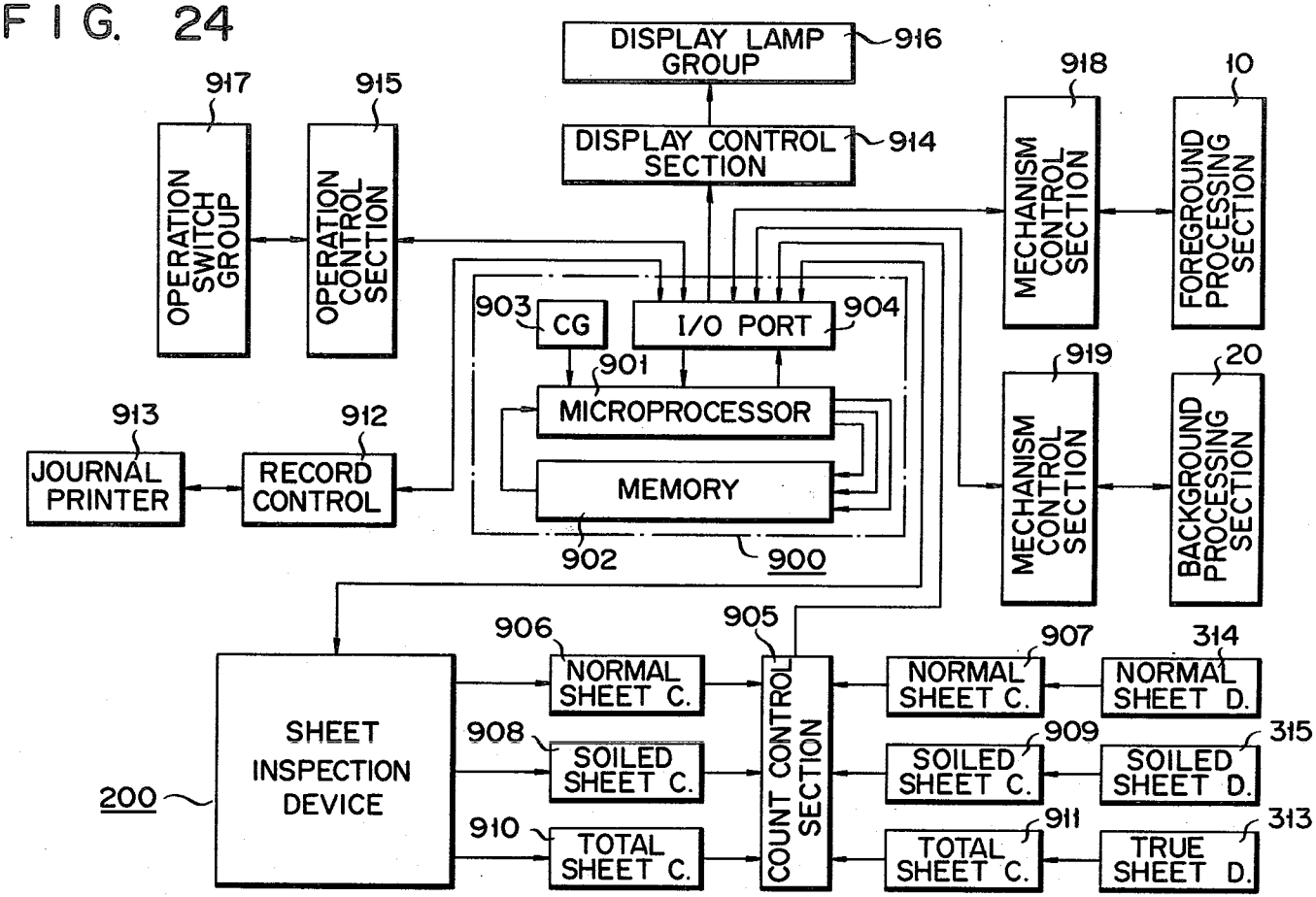
FIG. 24 is a block diagram of a control unit.

FIG. 24 illustrates in block form the control unit. A main control unit 900 is comprised of a microprocessor 901, a memory 902, a clock generator 903 and an input-/output port 904. Connected to the main control unit 900 are the inspection unit 200 shown in FIG. 2 and a counter control unit 905 to which normal sheet counters 906 and 907, soiled sheet counters 908 and 909, and total counters 910 and 911. Responding to normal sheet, soiled sheet and total signals from the inspection device 200, the respective counter 906, 908 and 910 counts the number of the normal sheets, the number of the soiled sheets, and the total number of those sheets (only true sheets), and produce the contents of the counters for application to the counter control unit 905. The other counters, a normal sheet counter 907, a soiled sheet counter 909 and a total sheet counter 911, respond respectively the output signals from a normal sheet detector 315, a soiled sheet detector 313 and a true sheet detector 313 and count respectively the number of the normal sheets, the number of the soiled sheets and the total number of the normal sheets and the soiled sheets. The contents of the counters are then applied to the count control unit 905. The counter control unit 905 compares the contents of the counters 906, 908 and 910 with the contents of the counters 907, 909 and 911, and if there is found even a single coincidence between the corresponding them, produces a signal representing it toward the main control unit 900 thereby to prevent an erroneous count. The counter control unit 905 delivers the contents of each counter 906 to 911 to the main control unit 900. The main control unit 900 is connected to a record control unit 912 which is further connected to a journal printer 913 to print out the contents of the processing.

The main control unit 900 is connected to a display control unit 914 and an operation control section 915. The display control unit 914 is connected to display lamps 916 such as various lamps and display devices provided on a display panel 700. Connected to an operation control unit 915 are operation switches 917, such as push buttons, provided on the display panel 700 and an operation board 701. The main control unit 900 is further connected to a mechanism control unit 918 of the pre-processing unit to control the preprocessing device shown in FIG. 1 and a mechanism control unit 919 of the post-processing unit to control the post-processing device shown in FIGS. 13 and 14.

As described above, the sheet-like material processing apparatus of the present invention is provided with the invalidating device to invalidate the soiled sheet-stacks transferred for preventing the reuse of the soiled sheets at the prestage of the soiled sheet-stack collecting device. As a result, the apparatus per se can automatically invalidate the soiled sheet-stacks. This feature eliminates the troublesome and inefficiency work in which the soiled sheet-stacks are collected and then are supplied by the hands to the punching machine. Accordingly, the handling of the soiled sheet-stacks after invalidated is easy. Further, the supply of the soiled sheets to the invalidating section may be made automatically. This remarkably saves the labor.

The provision of the tightly bundling device for tightly bundling the normal sheet bundles and the invalidated soiled sheet bundles every 10 bundles further simplifies the handling of the normal sheet bundles and the soiled sheet bundles. The process from a step of the supply of the sheets to a step to tightly bundling the sheet-stacks of a given number may entirely automatically be performed. Additionally, the provision of the bundle detecting device to check whether or not the sheet bundles affter the tightly bundling process are 10, enables the check as to if the tightly bundling made every 10 bundles is performed accurately or not. This further improves the accuracy of the processing of the sheet-like material.

What we claim is:

1. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into first and second classes;

first collecting means for collecting a predetermined number of said sorted sheets for each of said first and second classes;

first bundling means for bundling said collected sheets together into packets of said first class;

transfer means for transferring said packets;

second collecting means for collecting a predetermined number of said transferred packets of said first class; and invalidated means for invalidating a predetermined number of said second class sheets.

2. A sheet processing apparatus according to claim 1, further comprising second bundling means for bundling said packets of said first class sheets into bundles.

3. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into said first and second classes;

first collecting means for collecting a predetermined number of said sorted sheets for each of said first and second classes;

first bundling means for bundling said collected sheets together into packets for each of said first and second classes;

transfer means for transferring said packets;

second collecting means for collecting a predetermined number of said transferred packets for each of said first and second classes; and second bundling means for bundling said collected packets together into bundles for each of said first and second classes.

4. A sheet processing apparatus according to claim 3, wherein said second bundling means comprises:

relatively movable chuck means for holding said collected packets;

means for moving said chuck means between holding and released positions so that said collected packets can be held and released, respectively, by said chuck means upon predetermined operation of said moving means;

winding means for winding a tape in one direction around said collected packets when said chuck means is in said holding position; and rotating means for rotating said collected packets when said chuck means is in said released position through an angle of about 90° so that upon operation of said winding means after said rotating means rotates said collected packets, said tape is wound around said collected packets by said winding means in a direction substantially normal to said first mentioned direction.

5. A sheet processing apparatus as in claim 4 further comprising supply means for supplying said collected packets to said chuck means and chuck transfer means for transferring said collected packets from said chuck means.

6. A sheet processing apparatus according to claim 3, further comprising means defining a common transfer path for transferring said packets for each of said first and second classes bundled by said first bundling means.

7. A sheet processing apparatus according to claim 3, further comprising means defining a common transfer path for transferring said packets for each of said first and second classes bundled by said first bundling means and detecting means for detecting a predetermined feature of a strip on said packets at the midportion of said common path.

8. A sheet processing apparatus according to claim 7, wherein said detecting means includes means for determining the color of said strip.

9. A sheet processing apparatus according to claim 3, wherein said transfer means includes means defining a common transfer path for transferring said packets for each of said first and second classes, and means for pushing said packets in a direction normal to said common transfer path thereby sorting said packets into said first and second classes.

10. A sheet processing apparatus according to claim 3, wherein said transfer means includes means defining a common transfer path for transferring said packets for each of said first and second classes, and means for pushing said packets in a direction normal to said common transfer path thereby sorting said packets into said first and second classes, said transfer means including with the kinds of the material, and a collecting means for collecting a predetermined number of sheets erroneously sorted, said collecting means being provided on a path extending from said common transfer path.

11. A sheet processing apparatus according to claim 3, further comprising vertical transfer means for transferring the packets for each of said first and second classes in a substantially vertical state.

12. A sheet processing apparatus according to claim 3, wherein said transfer means transfers said packets for each of said first and second classes in a substantially vertical state, said transfer means further comprising sorting means for sorting said packets into said first and second classes, after said packets are pushed from said transfer means.

13. A sheet processing apparatus according to claim 12, wherein said sorting means successively processes a couple of superposed packets each of said packets includng a predetermined number of sheets after said sheets have been sorted into said first and second classes.

14. A sheet processing apparatus according to claim 3, wherein said first bundling means includes single bundling means for bundling said collected sheets together into packets for each of said first and second classes.

15. A sheet processing appparatus according to claim 3, wherein said bundling means further includes checking means for checking whether the proper number of packets for each of said first and second classes have been bundled.

16. A sheet processing apparatus according to claim 15, wherein said checking means is a weight measuring apparatus.

17. A sheet processing apparatus according to claim 15, wherein said checking means is a thickness measuring apparatus.

18. A sheet processing apparatus according to claim 3, wherein said second bundling means winds, in a crossing manner, a strip around a predetermined number of said collected packets for each of said first and second classes.

19. A sheet processing apparatus according to claim 15, wherein said transfer means includes means for pushing out the acceptable bundles of packets from said transfer means and for transferring the unacceptable bundles of packets to a collecting means provided at a location extending from said transfer means.

20. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into first and second classes;

first collecting means for collecting a predetermined number of said sorted sheets for each of said first and second classes;

first bundling means for bundling said collected sheets together into packets for each of said first and second classes;

transfer means for transferring said packets;

second collecting means for collecting a predetermined number of said transferred packets for each of said first and second classes; and invalidating means for invalidating at least one packet of said second class sheets transferred by said transfer means.

21. A sheet processing apparatus according to claim 20, wherein said invalidating means further comprises punching means for punching said predetermined number of second class packets thereby invalidating them, and a transfer belt for transferring said predetermined number of second class packets through said punching means.

22. A sheet processing apparatus according to claim 21, wherein said punching means includes pin means projectable into the transfer path of said predetermined number of second class packets for stopping said second class packets within said punching means.

23. A sheet processing apparatus comprising:

sheet take-out/transfer means for taking out sheets set in a sheet supply section on a sheet-by-sheet basis and for transferring said sheets;

inspecting means for classifying said transferred sheets into at least a first and a second class;

transfer/sorting means for transferring and sorting said classified sheets into said first and second classes;

first collecting means for collecting a predetermined number of said sorted sheets for each of said first and second classes;

first bundling means for bundling said collected sheets together into packets for each of said first and second classes;

transfer means for transferring said packets;

second collecting means for collecting a predetermined number of said transferred packets for each of said first and second classes; and invalidating means for invalidating a predetermined number of said second class sheets prior to being collected by said second collecting means.

24. A sheet processing apparatus according to claim 23 wherein said invalidating means further comprises punching means for punching said predetermined number of second class sheets thereby invalidating them, and a transfer belt for transferring said predetermined number of second class sheets through said punching means.

25. A sheet processing apparatus according to claim 24 wherein said punching means includes pin means projectable into the transfer path of said predetermined number of second class sheets for stopping said second class sheets within said punching means.

26. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into said first and second classes;

first collecting means for collecting a predetermined number of said sorted sheets for each of said first and second classes;

first bundling means for bundling said collected sheets together into packets for each of said first and second classes;

first bundling means for bundling said collected sheets together into packets for each of said first and second classes;

transfer means for transferring said packets;

second collecting means for collecting a predetermined number of said transferred packets for each of said first and second classes;

invalidating means for invalidating at least one packet of said second class sheets transferred by said transfer means; and second bundling means for bundling said collected packets together into bundles for each of said first and second class.

27. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into said first and second classes;

first collecting means for collecting a predetermined number of said sorted sheets for each of said first and second classes;

first bundling means for bundling said collected sheets together into packets for each of said first and second classes;

transfer means for transferring said packets;

second collecting means for collecting a predetermined number of said transferred packets for each of said first and second classes;

invalidating means for invalidating a predetermined number of said second class sheets prior to being collected by said second collecting means; and second bundling means for bundling said collected packets together into bundles for each of said first and second classes.

28. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into said first and second classes;

first collecting means for collecting a predetermined number of said sorted sheets for each of said first and second classes;

first bundling means for bundling said collected sheets of at least said first class together into packets;

transfer means for transferring said packets;

second collecting means for collecting a predetermined number of said transferred packets of at least said first class; and second bundling means for bundling said collected packets together into bundles of at least said first class.

29. A sheet processing apparatus comprising:

sheet take-out/transfer means for taking out sheets set in a sheet supply section on a sheet-by-sheet basis and for transferring said sheets;

inspecting means for classifying said transferred sheets into at least a first and second class;

transfer/sorting means for transferring and sorting said classified sheets into said first and second classes;

first collecting means for collecting a predetermined number of said sorted sheets for each of said first and second classes;

first bundling means for bundling said collected sheets together into packets for each of said first and second classes;

transfer means for transferring said packets;

second collecting means for collecting a predetermined number of said transferred packets of at least said first class; and second bundling means for bundling said collected packets together into bundles of at least said first class.

* * * * *